US005523033A

United States Patent [19]

Shambaugh

[11] Patent Number: 5,523,033

[45] Date of Patent: Jun. 4, 1996

[54] POLYMER PROCESSING USING PULSATING FLUIDIC FLOW

[75] Inventor: Robert L. Shambaugh, Norman, Okla.

[73] Assignee: The Board of Regents of the University of Oklahoma, Norman, Okla.

[21] Appl. No.: 465,160

[22] Filed: Jun. 5, 1995

Related U.S. Application Data

[60] Division of Ser. No. 170,641, Dec. 20, 1993, Pat. No. 5,433,993, which is a continuation-in-part of Ser. No. 164, 173, Dec. 8, 1993, Pat. No. 5,405,559.

[51] Int. Cl.[6] ..... D01D 5/11

[52] U.S. Cl. ..... 264/6.000; 264/12; 264/40.1; 264/115; 264/517; 264/518; 364/476; 364/550

[58] Field of Search ..... 264/6, 12, 40.1, 264/115, 517, 518; 364/468, 476, 550

[56] References Cited

U.S. PATENT DOCUMENTS

| | | | |
|---|---|---|---|
| 4,380,570 | 4/1983 | Schwarz | 428/296 |
| 4,622,259 | 11/1986 | McAmish et al. | 428/171 |

OTHER PUBLICATIONS

E. H. Andrews, "Cooling of a Spinning Thread–Line", *Brit. J. Appl. Phys.*, 1959, 10(1), pp. 39–43.

S. Kase & T. Matsuo, "Studies on Melt Spinning. I. Fundamental Equations on the Dynamics of Melt Spinning", *J. Polym. Sci.*, 1965, Part A, 3, 2541–2554.

F. H. Champagne et al., "Turbulence Measurements With Inclined Hot–Wires. Part 1. Heat Transfer Experiments With Inclined Hot–Wire", *J. Fluid Mech.*, 1967, 28(1), 153–175.

C. D. Han & R. R. Lamonte, "Studies on Melt Spinning. I. Effect of Molecular Structure and Molecular Weight Distribution on Elongational Viscosity", *Trans. Soc. Rheol.*, 1972, 16(3), 447–472.

V. T. Morgan, *Advances in Heat Transfer*, Academic Press: New York, NY, 1975, vol. 11, pp. 239–243.

A. Ziabicki, *Fundamentals of Fibre Formation*, John Wiley and Sons: London, 1976, pp. 15–24 and 177–181.

M. Matsui, "Air Drag on Continuous Filament in Melt Spinning", *Trans Soc. Rheol.*, 1976, 20(3), 465–473.

F. W. Billmeyer, *Textbook of Polymer Science*, 3rd ed., Wiley–Interscience: New York, NY, 1984, pp. 502–503.

R. L. Shambaugh, "Macroscopic View of the Melt Blowing Process for Producing Microfibers", *Ind. Eng. Chem. Res.*, 1988, 27(12), 2363–2372.

M. A. Uyttendaele & R. L. Shambaugh, "The Flow Field of Annular Jets At Moderate Reynolds Numbers", *Ind. Eng. Chem. Res.*, 1989, 28(11), 1735–1740.

M. A. Uyttendaele & R. L. Shambaugh, "Melt Blowing: General Equation Development and Experimental Verification", 1990, *AIChE J.*, 36(2), 175–186.

J. C. Kayser & R. L. Shambaugh, "The Manufacture of Continuous Polymeric Filaments by the Melt–Blowing Process", *Polym. Eng. Sci.*, Mid–Oct., 1990, 30(19), 1237–1251.

B. Majumdar & R. L. Shambaugh, "Velocity and Temperature Fields of Annular Jets", *Ind. Eng. Chem. Res.*, 1991, 30(6), 1300–1306.

A. Mohammed & R. L. Shambaugh, "Three–Dimensional Flow Field of a Rectangular Array of Practical Air Jets", *Ind. Eng. Chem. Res.*, 1993, vol. 32, No. 5, 1993.

Y. D. Ju & R. L. Shambaugh, "Air Drag on Fine Filaments at Oblique and Normal Angles to the Air Stream", accepted for publication in *Polym. Eng. & Sci.*, 1993, 1–18.

*Primary Examiner*—Leo B. Tentoni
*Attorney, Agent, or Firm*—Dunlap & Codding

[57] ABSTRACT

A method of attenuating a molten thermoplastic polymer stream into polymer fibers for forming a non-woven fiber mat, and the non-woven fiber mat formed thereby. The method applying a gas stream to a molten polymer stream, and inducing a cyclic pulsation in the gas stream. The cyclic pulsation further comprises a discontinuous flow of the gas stream. The application of the gas stream to the molten polymer stream causes the attenuation of the molten polymer stream into a plurality of fibers which are collected onto a receiving surface thereby forming a non-woven fiber mat. The method may be used to impart a particularly unique or otherwise desirable configuration to the fibers or to the fiber mat produced from them. The gas stream may be comprised of a primary gas flow having a first stream and a second stream. The gas stream may be further comprised of a secondary gas flow having a first stream and a second stream. The gas stream may be further comprised of a plurality of gas flows each having one or more gas flows. The invention further comprises a model to predict the thermal and mechanical behavior of a polymer stream after it exits a melt blowing die. The model is a logical extension of the Uyttendaele and Shambaugh model for melt blowing. The model takes into account the fiber vibrations that become pronounced during high velocity melt blowing and can be used to estimate the experimental conditions that will cause fiber breakage, as well as the optimum frequency of the pulsation.

2 Claims, 29 Drawing Sheets

POLYMER PROCESSING USING PULSATING FLUIDIC FLOW

RELATED REFERENCES

The present application is a divisional application of U.S. Ser. No. 08/170,641, filed Dec. 20, 1993, entitled "POLYMER PROCESSING USING PULSATING FLUIDIC FLOW", now U.S. Pat. No. 5,433,993, issued Jul. 18, 1995, which is a continuation-in-part of U.S. Ser. No. 08/164,173, filed Dec. 8, 1993, entitled "POLYMER PROCESSING USING PULSATING FLUIDIC FLOW", now U.S. Pat. No. 5,405,559, issued Apr. 11, 1995.

BACKGROUND

The present invention relates to processes for forming fibers and materials formed therefrom. Melt blowing and other fiber-producing processes are processes in which the final polymer shape is achieved with the aid of a fluid flow. In the melt blowing process, for example, a fine polymeric stream is extruded into a high-velocity gas stream. The force of the gas rapidly attenuates the polymer into fibers or filaments which typically have very fine diameters in a range of from 0.1 microns to 100 microns. This extreme fineness gives melt blown fibers advantages in uses such as insulation, absorbent material, and filters. An overview of the melt blowing process is given in Shambaugh, R. L., 1988, A Macroscopic View of the Melt-Blowing Process for Producing Microfibers, *Ind. Eng. Chem. Res.* Vol. 27, No. 12, pgs. 2363–72. The performance characteristics of various melt blowing geometries are given in Kayser, J. C., Shambaugh, R. L., 1990, The Manufacture of Continuous Polymeric Filaments by the Melt-Blowing Process, *Polymer Engineering and Science*, Vol. 30, No. 19, pgs. 1237–51. Further discussion of the melt blowing process and other performance characteristics is found in Uyttendaele, M. A., Shambaugh, R. L., 1989, The Flow Field of Annular Jets at Reynolds Numbers, *Ind. Eng. Chem. Res.*, Vol. 28, No. 11, pgs. 1735–40; Majumdar, B., Shambaugh, R. L., 1991, Velocity and Temperature Fields of Annular Jets, *Ind. Eng. Chem. Res.*, Vol. 30, No. 6, pgs. 1300–06; and Mohammed, A., Shambaugh, R. L., 1993, Three-Dimensional Flow Field of a Rectangular Array of Practical Air Jets, *Ind. Eng. Chem. Res.*, Vol. 32, No. 5, pgs. 976–80; and Uyttendaele, M. A., Shambaugh, R. L., 1990, Melt Blowing: General Equation Development and Experimental Verification, *AIChE J.*, 36 (No. 2), 175. Each of the references cited herein is hereby incorporated herein by reference.

Large amounts of air must be compressed, heated and recycled in a typical commercial melt blowing facility. Substantial cost savings would result if the air requirements needed to produce fibers of a given size or shape could be reduced.

SUMMARY OF THE INVENTION

Conventional polymer fiber producing operations use gas applied in a continuous flow. The present invention instead uses a pulsating gas flow to attenuate the polymer stream into fibers. Surprisingly, when gas is provided in a pulsating flow to a polymer stream, the diameters of the fibers which are produced are substantially smaller than if the gas is provided in a continuous flow at the same flow rate. As a result, when it is desired to produce a fiber having a particular diameter, if the gas is supplied as a pulsating flow, a lesser total volume of gas is required. Since a lesser volume is needed, the costs of compressing, heating and recycling the gas are substantially reduced. The present invention also comprises a method for selecting the operating conditions in a melt blowing operation.

BRIEF DESCRIPTION OF THE DRAWINGS

FIGS. 6A–6C is a cross-sectional view of an alternately pulsating primary flow.

FIG. 9 is a bottom plan view of a slotted die having eight separate gas discharge zones.

FIGS. 19A–19C is a cross-sectional view of one constant primary gas flow with pulsating second primary flow with continuous secondary flow.

FIG, 37 is a graph showing the effect of polymer temperature on the fiber diameter and the fiber temperature.

Figure 38:
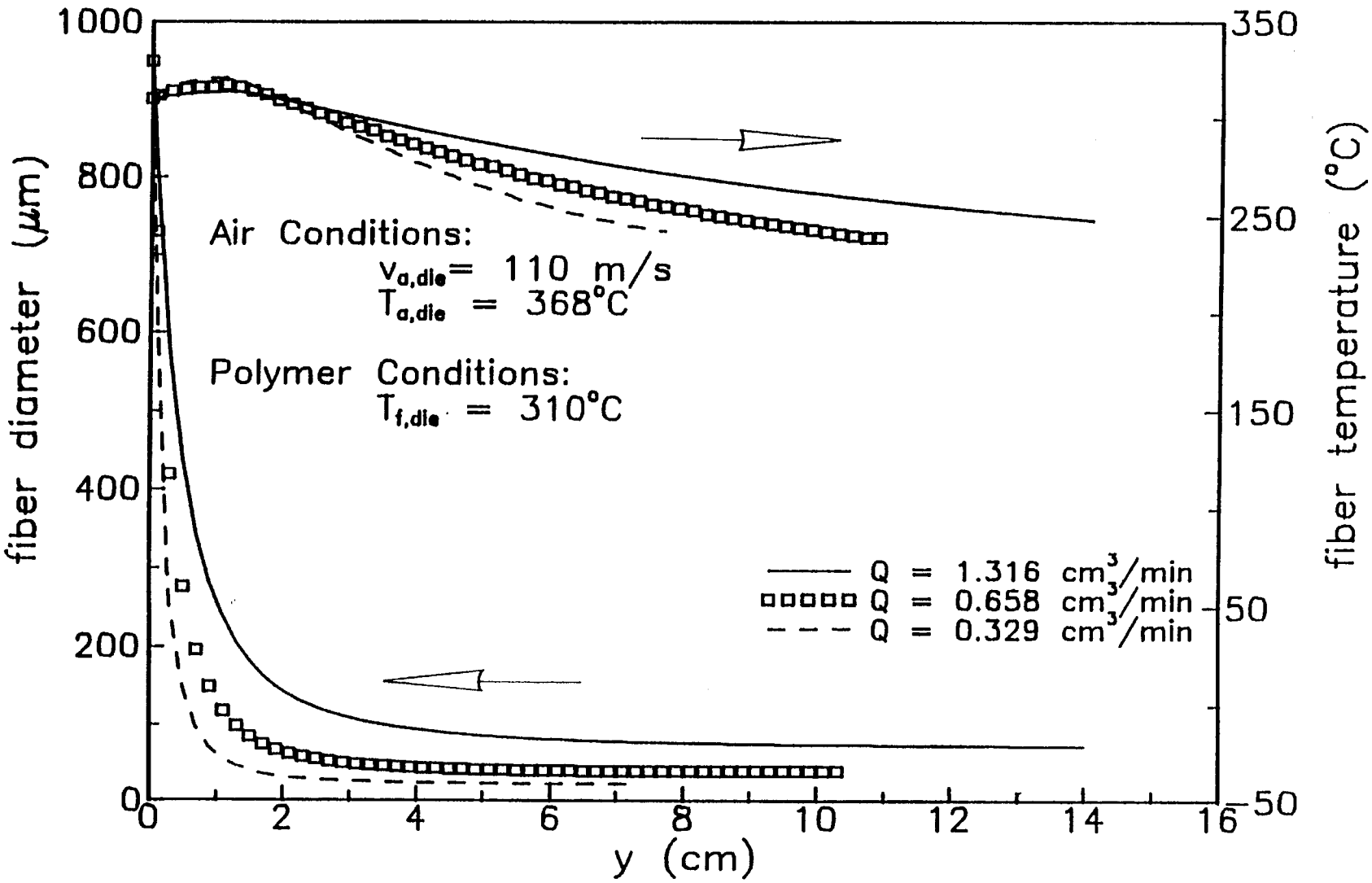

FIG. 38 a graph showing the effect of polymer flowrate on fiber diameter fiber temperature.

Figure 39:
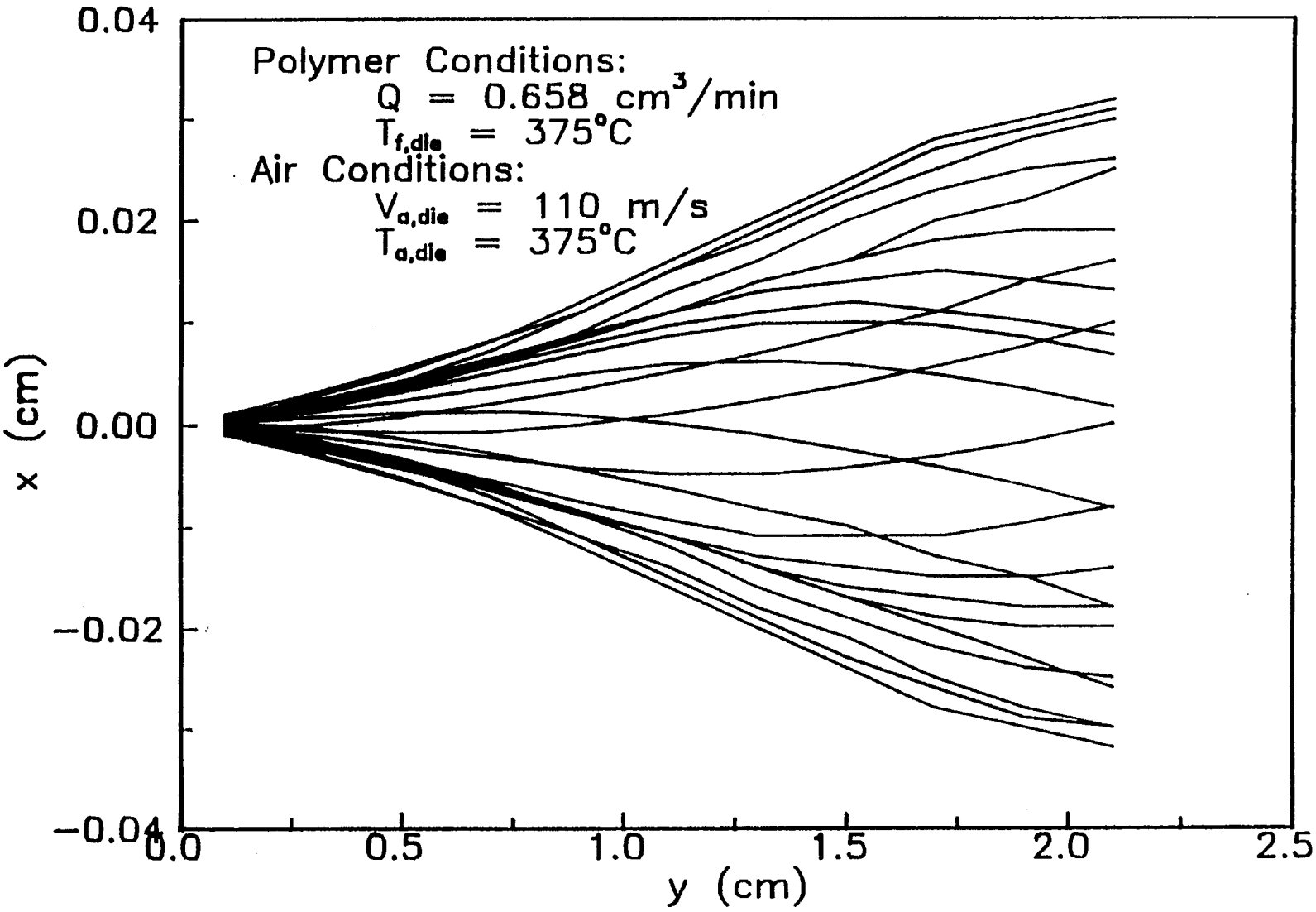

FIG. 39 is a graphical representation of fiber motion as predicted by the present model.

DESCRIPTION OF THE INVENTION

The present invention provides a method for reducing gas requirements in polymer fiber producing operations, thereby reducing associated costs, by pulsating the gas flow used during the operations. Conventional polymer fiber producing operations use gas applied in a continuous flow. The present invention instead uses a pulsating gas flow to attenuate the polymer stream into fibers. Surprisingly, when gas is provided in a pulsating flow to a polymer stream, the diameters of the fibers which are produced are substantially smaller than if the gas is provided in a continuous flow at the same gas flow rate. As a result when it is desired to produce a fiber having a particular diameter, if the gas is supplied as a pulsating flow, a lesser volume of gas is required. Since a lesser gas volume is needed, the costs of compressing, heating and recycling the gas can be substantially reduced. In a preferred version of the present invention using a pulsating gas flow, wherein the gas is air, there is a reduction in average fiber diameter of about 5% to 40% or more versus the average fiber diameter produced under continuous air flow at the same air flow rate.

The invention further comprises a method for selecting operating conditions in a melt blowing operation. The method comprises the steps of first providing a mathematical model which simulates a polymer stream in a melt blowing process and which accounts for transverse motion of fibers in the polymer stream and then providing a set of parameter values for inputting into the model. The model is then run with the set of parameter values. From this set of parameter values is selected a subset of parameter values which is shown by the results of the model to optimize the melt blowing process. This subset of parameter values is then used in an actual melt blowing operation.

Most conventional melt blowing operations use slot-type dies such as those shown in U.S. Pat. No. 4,622,259 issued to McAmish et al. Other dies such as those disclosed in U.S. Pat. No. 4,350,570 issued to Schwarz have an annular configuration. Each of these dies is supplied, at a minimum, with a primary gas flow for attenuating the heated polymer stream. The primary gas flow may be supplemented with a secondary gas flow as shown in U.S. Pat. No. 4,622,259. In the present invention either the primary gas flow, or the secondary gas flow, or both may be pulsated as is explained in greater detail below. The present invention also contemplates a plurality of gas flows. For example, one version of the invention may comprise a primary gas flow, a secondary gas flow and a tertiary gas flow. The invention may further comprise quaternary or additional gas flows. A large number of separate gas flows may then be seen to be involved in the overall fiber producing process.

Moreover, another factor in which alterations can be contemplated is the temperature of the gas flows. Temperatures of the primary and secondary gas flows may be varied such that the primary gas flow is a different temperature, either higher or lower, than the secondary gas flow. For example, the primary gas flow may be heated while the secondary gas flow has an ambient temperature, or vice versa. Similarly, a third or fourth (or more) gas flow may have temperatures, higher or lower, than the primary or secondary flows.

Although it is contemplated that compressed air will be the preferred fluid to be used in the present invention, other gases (e.g., nitrogen, steam, argon or others) could also be used. Also, instead of a gas, the fluid used in the present invention could comprise a liquid such as a hot oil. Further, any fiber-making process that involves the contacting of the fiber with a fluid (e.g., spunbonding or conventional melt spinning) might also take advantage of fluid pulsation. Also, formation of shapes other than fibers are contemplated as falling under the auspices of the present invention. Sheet structures (e.g., films) and extruded shapes (e.g., tubes and I-beams) are examples of these other shapes.

The present invention generally comprises a method of attenuating molten polymer streams into polymeric fibers for forming a non-woven fiber mat (wherein the term mat includes three-dimensional structures). The method has the basic steps of extruding a molten polymer to form a molten polymer stream, providing a gas stream for applying to the molten polymer stream, applying the gas stream to the molten polymer stream, and inducing a cyclic pulsation in the gas stream. The term polymer as used herein means a synthetic material such as a thermoplastic or a natural organic material such as pitch or cellulose, or a mineral material such as glass, any of which are fiber-forming materials.

The cyclic pulsation further comprises a discontinuous flow of the gas stream. The application of the gas stream to the molten polymer stream causes the attenuation of the molten polymer stream into one or more fibers which are collected onto a receiving surface thereby forming the non-woven fiber mat.

In a preferred embodiment of the present invention, the average diameter of the fibers produced is in a range of from about 5% to about 40% less than an average diameter of fibers produced using only a continuous, non-pulsating gas stream, wherein the gas stream flow rate is the same for both the pulsating gas stream and the non-pulsating gas stream. Other versions of the present invention may result in fibers above or below this range in comparison to continuous non-pulsating gas streams. The method contemplates use of a cyclic pulsation having a frequency which produces fibers having an average diameter which is significantly less than the average diameter of fibers produced using only a continuous, non-pulsating gas stream under conditions wherein the continuous, non-pulsating gas stream is applied at the same flow rate as the pulsating gas stream (wherein significance is determined at a 95% level of confidence). Alternatively, the method may be used in cases where reduction in gas volume is not important but instead where the process imparts a particularly unique or otherwise desirable configuration to the fibers or to the fiber mat produced from them. The cyclic pulsation may have a frequency in the range of from 1 Hz to about 55 Hz, or it may have another frequency which is effective in achieving the result contemplated herein. The gas stream may be comprised of a primary gas flow having a first stream and a second stream or a plurality of streams. The gas stream may be further comprised of a secondary gas flow having a first stream and a second stream or a plurality of streams. Or, the gas stream may be comprised of a plurality of gas flows (for example, a primary, secondary and tertiary gas flow) each comprising one, two or more separate streams.

Experimental Set-Up

Figure 1:
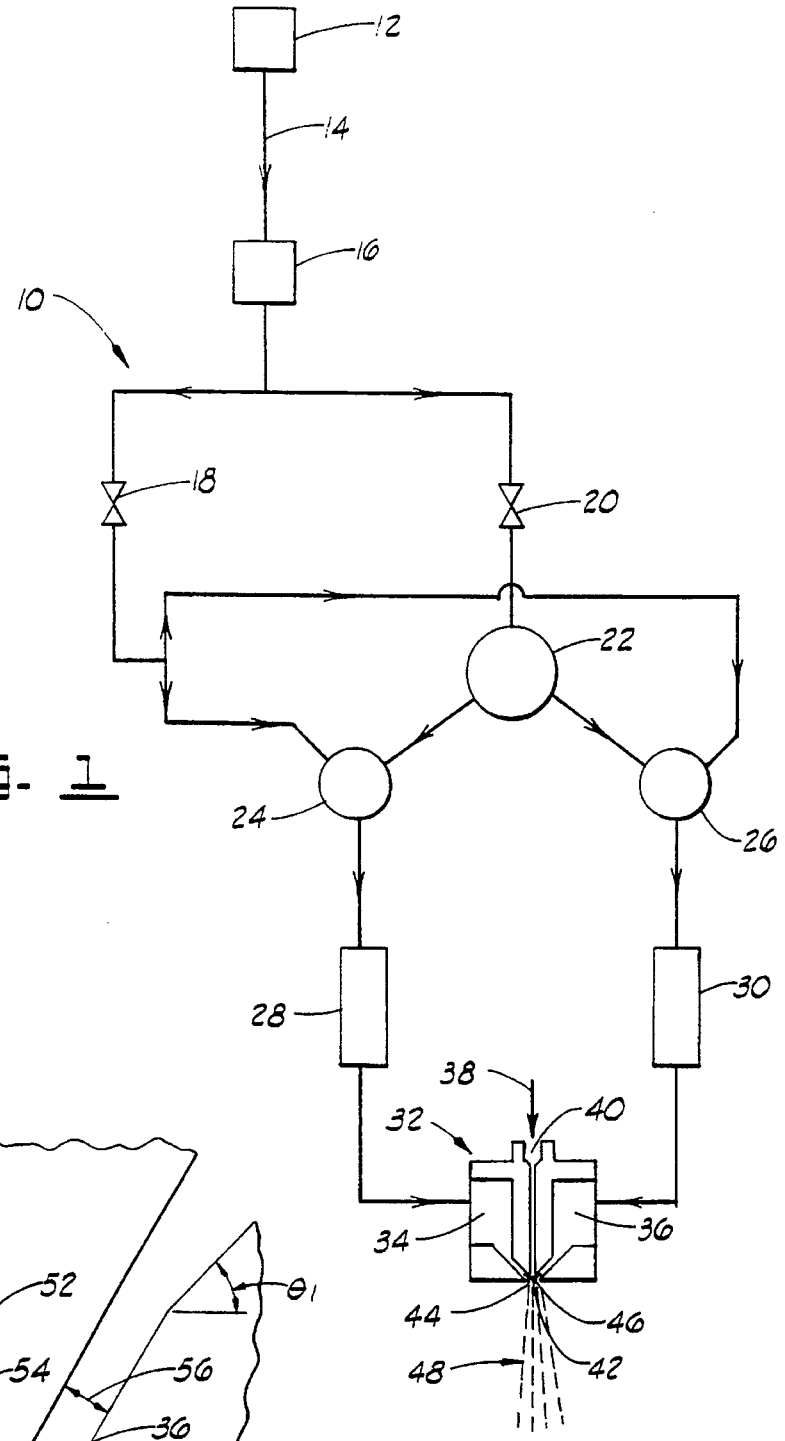
FIG. 1 shows a schematic of an apparatus for inducing pulsations in fluid flow to a die.

Shown in FIG. 1 is a schematic drawing of an apparatus having the general reference numeral 10. A compressed gas source 12 provides a gas 14, such as air, which is fed through a flowmeter 16. The gas 14 is passed through a first valve 18 or a second valve 20 enabling the gas to be used in a conventional (non-pulsating) mode or a pulsating mode. A fast-acting solenoid valve 22 permits rapid changes in gas flow to a first 3-way valve 24 and a second 3-way valve 26. Gas passing from the first 3-way valve 24 is heated by being passed from a first heater 28 and gas passing from the second 3-way valve 26 is heated by being passed through a second heater 30 on its way to a melt blowing die 32. Gas passing through the first heater 28 then passes into a first gas slot 34 and gas passing through the second heater 30 then passes into a second gas slot 36. Polymer 38 is fed into the entry portal 40 of the die 32 where it is heated to a temperature above its melting point. The melted polymer 38 is ejected from the exit portal 42 of the die 32 where it enters both a heated gas stream which is exiting from the end 44 of the first gas slot 34 and a heated gas stream which is exiting from the end 46 of the second gas slot 36 whereby the polymer 38 is attenuated into a stream 48 of tiny fibers which is laid down to form a non-woven web or mat of material (not shown).

Figure 2:
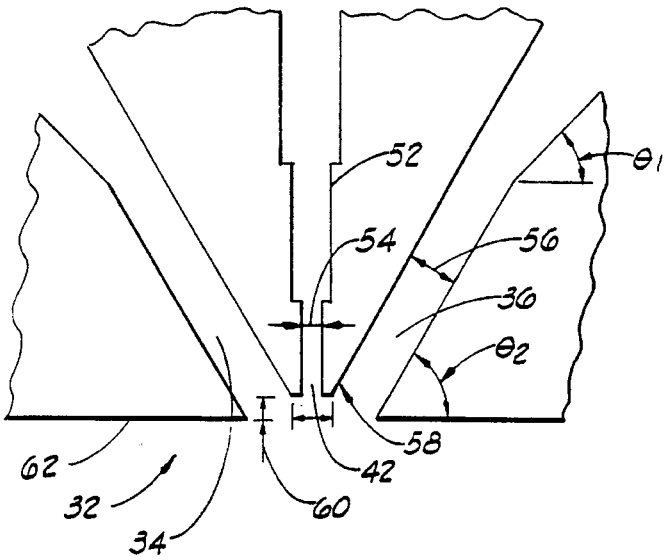
FIG. 2 is a cross-section through a melt blowing die.

The die 32 used in the experiments was similar to the slot dies which are commercially available. The configuration and geometry of the die 32 is shown in FIG. 2. The die 32 had a single polymer capillary 52 having a width 54 at the exit portal 42. The width 54 was 0.014 inches. The first gas slot 34 and the second gas slot 36 each had a slot width 56 of approximately 0.025 inches. The nosepiece 58 of the die 32 had a set back distance 60 of zero where set back distance 60 is defined as the distance the nosepiece 58 is set back from the lower surface 62 of the die 32. These values for slot width 56 and set back distance 60 are typical for commercial melt blowing processes.

In operation during the experimental runs, in the pulsating mode, the first valve 18 was closed and the second valve 20 was open to allow gas to flow through the solenoid valve 22. The first 3-way valve 24 and the second 3-way valve 26 were set to permit flow from the solenoid valve 22 into the first gas heater 28 and into the second gas heater 30. Temperatures of the heaters 28 and 30 were equal. In a conventional, non-pulsating mode, the first valve 18 was open and the second valve 20 was closed and the two 3-way valves 24 and 26 were set to permit flow from the first valve 18 the gas heaters 28 and 30.

Polymer pellets were heated and pressurized in a 19.1 mm diameter, electrically heated Brabender extruder with an L/D of 20. The extruder fed a Zenith gear pump which provided accurate control of polymer flowrate. Kayser and Shambaugh (1990) cited above give further experimental details. The polymer used was commercial 75 MFR (melt flow rate) Fina Dypro* polypropylene. Air flowrates were set at 54 SLPM (standard liters per minute), 100 SLPM, and 144 SLPM for three separate runs. The polymer flowrate was at 0.42 gm/min for each run. The gas temperature was 400° C., the extruder temperature was 225° C., and the polymer temperature (at the die) was 310° C. The pulsation frequency was varied from 1 to 55 Hz in each run. Equal amounts of air were routed to each flow branch. The diameters of the fibers produced were determined by averaging twenty diameter measurements taken with an optical microscope with a micrometer eyepiece.

Experimental Results

The results of the experiments are shown in FIGS. 3–5 and 21–24. The average fiber diameter is plotted as a function of the pulsation frequency where frequencies range from 1 to 55 Hz. Also represented on each figure by a horizontal line is the average fiber diameter produced under continuous (non-pulsating) gas flow conditions (54 SLPM in FIG. 3, 100 SLPM in FIG. 4 and 144 SLPM in FIG. 5). The results show that for most frequencies pulsation of the air causes a significant reduction in the fiber diameter from the fiber diameter produced under continuous gas flow at an identical gas flow rate.

Figure 3:
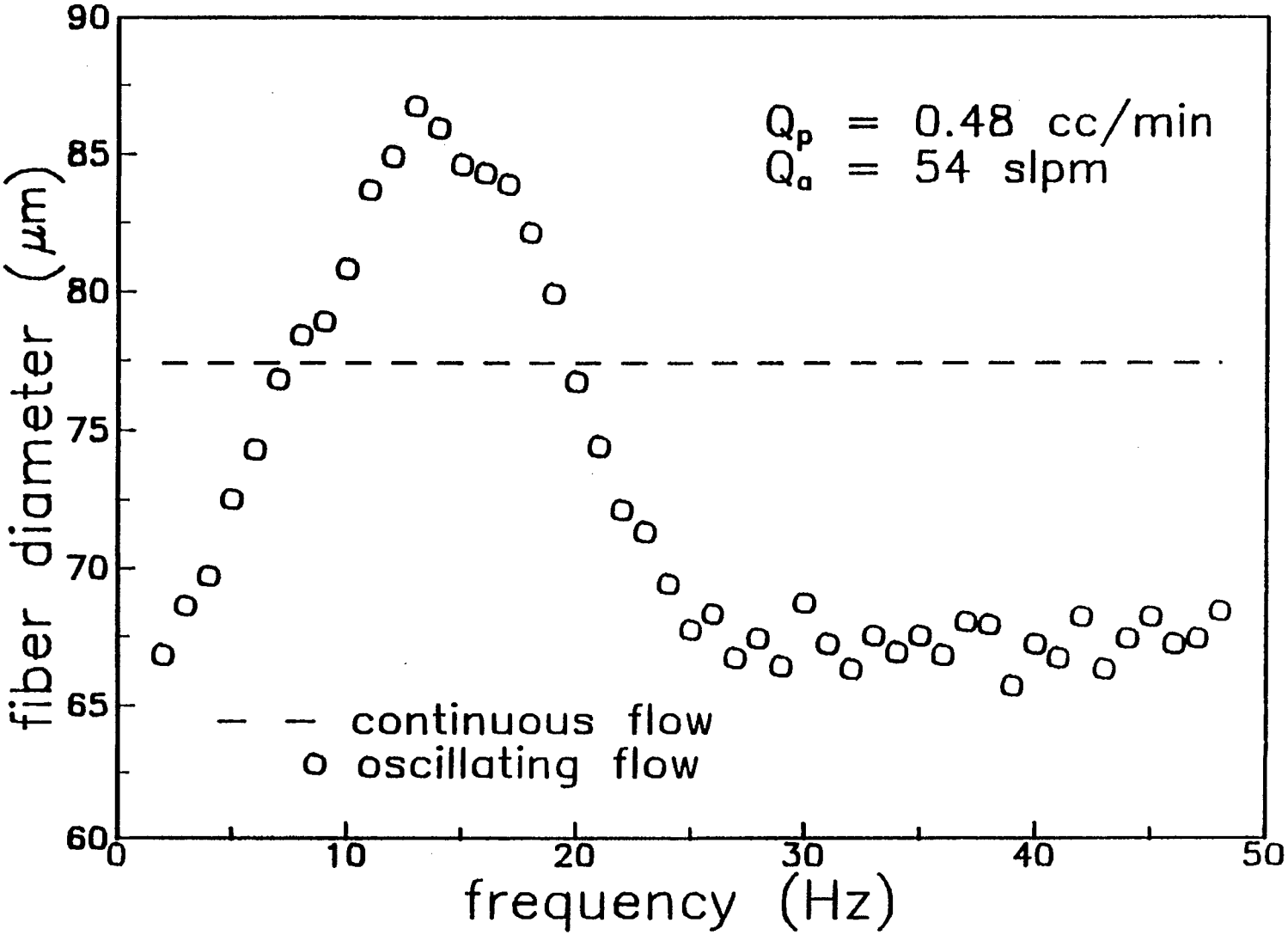
FIG. 3 is a graph of fiber diameters produced under a range of pulsation frequencies at 54 SLPM.
Figure 4:
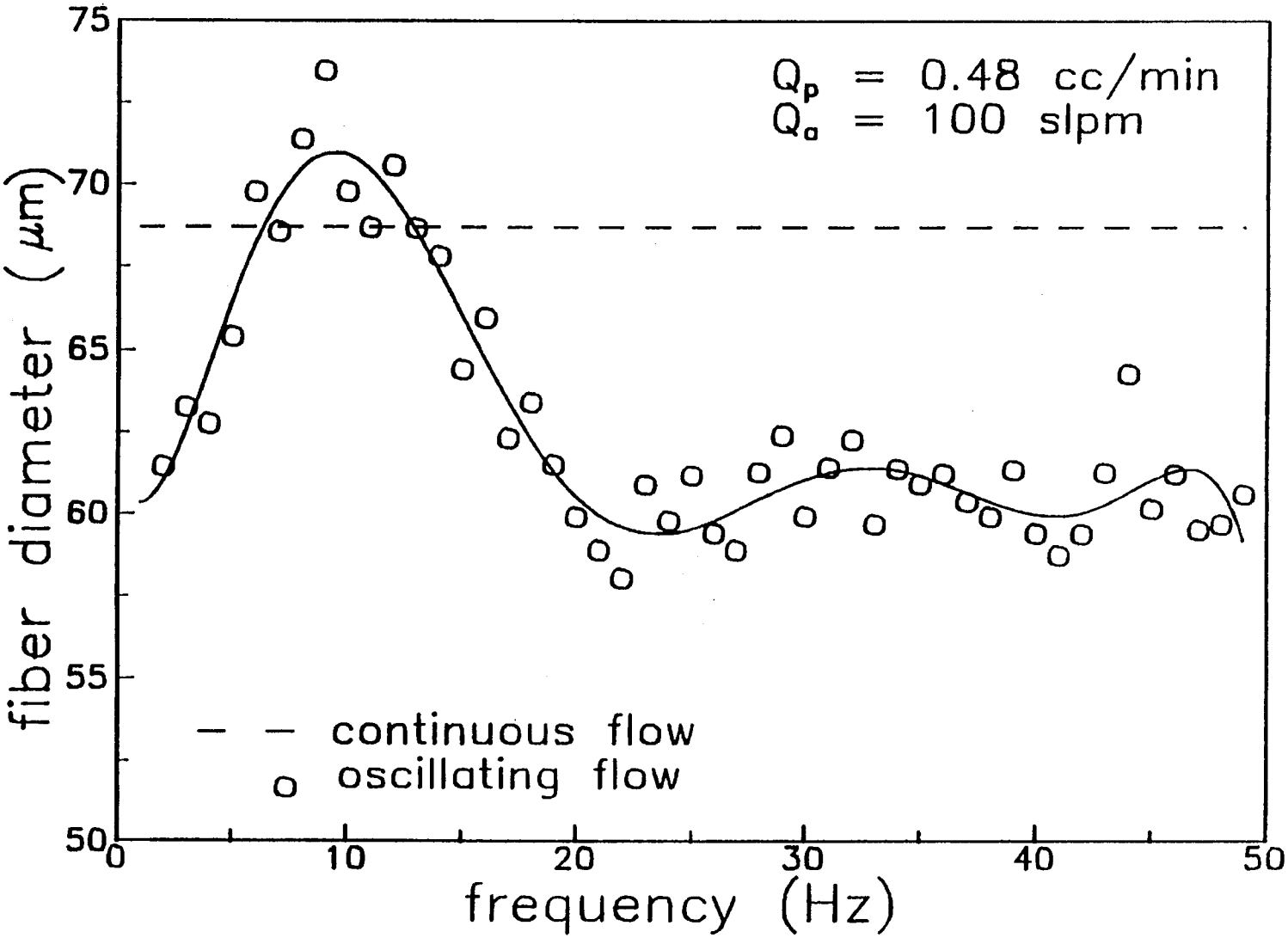
FIG. 4 is a graph of fiber diameters produced under a range of pulsation frequencies at 100 SLPM.
Figure 5:
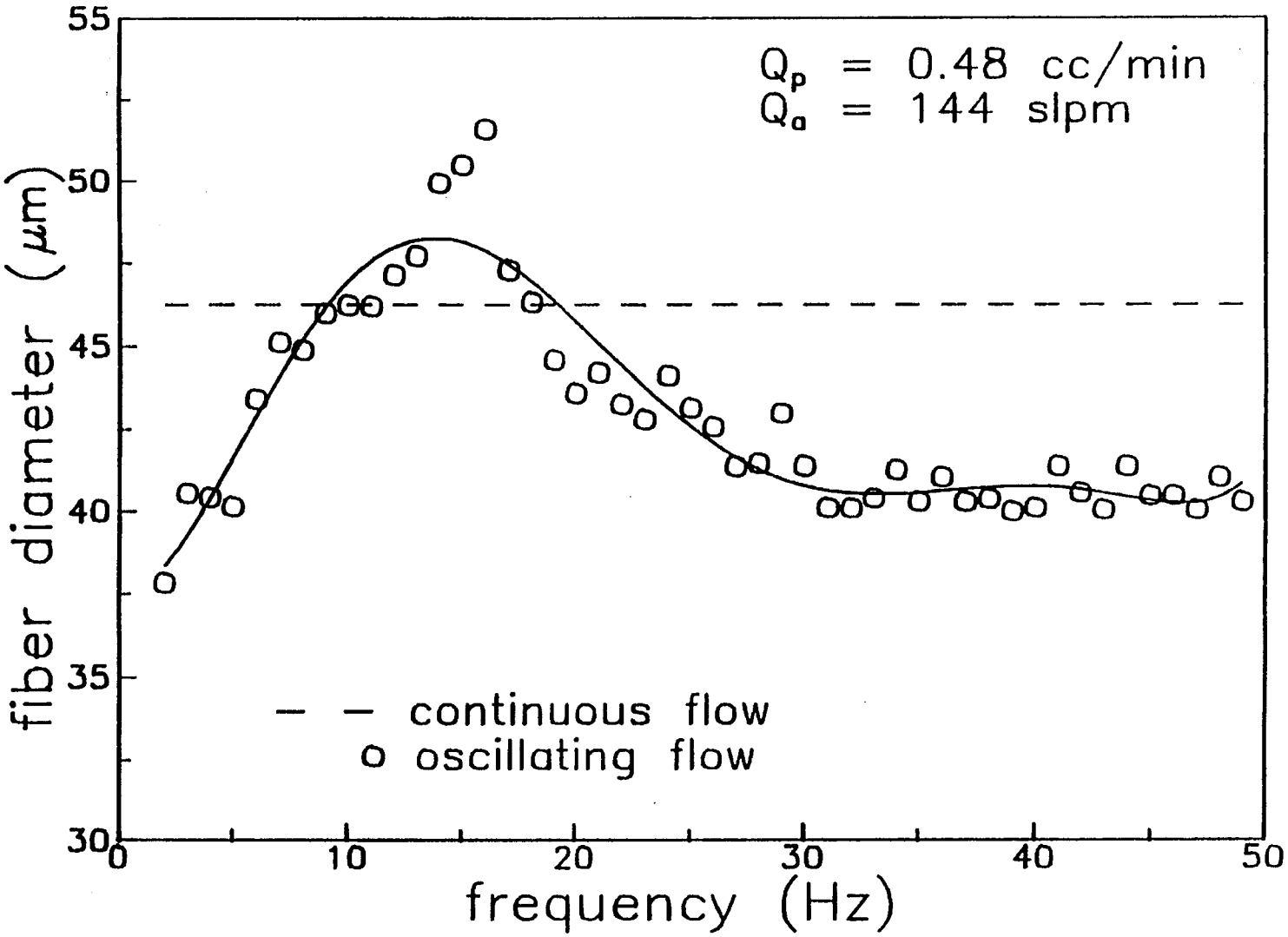
FIG. 5 is a graph of fiber diameters produced under a range of pulsation frequencies at 144 SLPM.

FIG. 3 shows that under continuous gas flow at a rate of 54 SLPM the average fiber diameter is approximately 75 microns. When the gas flow is pulsated at varying frequencies, the fiber diameter varies from 59 to 96 microns. FIG. 4 shows that under continuous gas flow at a rate of 100 SLPM the average fiber diameter is approximately 68 microns. When the gas flow is pulsated at varying frequencies under the same gas flow rate, the fiber diameter varies from 43–71 microns. FIG. 5 shows that under continuous gas flow at a rate of 144 SLPM the average fiber diameter is approximately 47 microns. When the gas flow is pulsated at varying frequencies under the same gas flow rate, the fiber diameter varies from 30–63 microns.

FIGS. 21–25 show that when process parameters (air flowrate, air temperature, polymer temperature and polymer flowrate) are modified, the result of reduced fiber diameters with air flow pulsation is robust.

The results also show that there are certain pulsation frequencies which are optimal for producing fibers of reduced diameter under given sets of conditions such as those utilized in the present experimental setting. For example in the results shown in FIG. 4 especially optimal pulsation frequencies are 6 and 52 Hz, giving average fiber diameters of 60 and 59 microns, respectively. This is a reduction in fiber diameter of about 20% versus the average fiber diameter under continuous gas flow. In FIG. 5 especially optimal pulsation frequencies are 4, 7 and 46 Hz, giving average fiber diameters of 42, 44 and 52 microns, respectively. This is a reduction in fiber diameter of from about 23% to 38% versus the average fiber diameter under continuous gas flow. In FIG. 6 an especially optimal pulsation frequency is 44 Hz, giving an average fiber diameter of 30 microns. This is a reduction in fiber diameter of about 36% versus the average fiber diameter produced under continuous gas flow at the same gas flow rate.

Methods of Pulsating Gas Flow

Pulsating Primary Gas Flows

Alternately Pulsating Primary Gas Flow

Pulsation of gas flow can be induced using a number of methods depending on the arrangement of the gas flow slots in relation to the polymer flow. FIGS. 6A–6C represent an alternating pulsation of primary gas flows. Shown in FIGS. 6A–6C is a melt blowing die designated by the general reference numeral 80. The die 80 has a polymer flow channel 82, a first primary gas flow slot 84, and a second primary gas flow slot 86. A first gas flow 88 discharging from the first primary gas flow slot 84 alternates with a second gas flow 90 discharging from the second primary gas flow slot 86. The alternating pulsating primary gas flow technique shown herein was the method utilized to produce the experimental results shown above.

In the alternating pulsating primary gas flow version of the present invention shown herein, the first gas flow 88 alternates with the second gas flow 90 while a polymer flow 92 flows continuously through the polymer flow channel 82. More particularly FIG. 6A shows the first gas flow 88 discharging from the first primary gas flow slot 84 while no gas is discharging from the second primary gas flow slot 86. FIG. 6B shows the second gas flow 90 discharging from the second primary gas flow slot 86 while no gas is discharging from the first primary gas flow slot 84. FIGS. 6A and 6B thus represent one complete pulsation cycle. FIG. 6C represents the initiation of another cycle wherein the discharge of the first gas flow 88 resumes.

Although the frequencies utilized in the experimental work discussed above ranged from 1 to 55 cycles per second, it will be understood by one of ordinary skill in the art that the range of frequencies utilized is limited only by the equipment employed and that frequencies less than or in excess of those used herein could be employed in any of the versions of the present invention described within this specification.

Synchronously Pulsating Primary Gas Flow

Figure 7A:
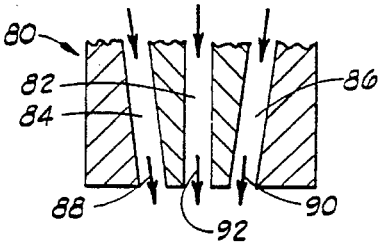
FIGS. 7A–7C is a cross-sectional view of a synchronously pulsating primary gas flow.
Figure 7B:
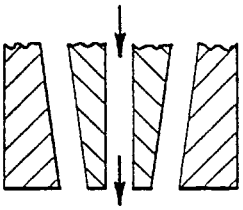
Figure 7C:
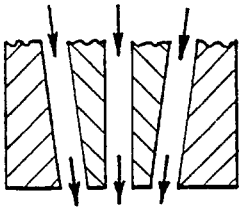

Shown in FIGS. 7A–7C is a melt blowing die 80 which is exactly the same as the melt blowing die 80 shown in FIGS. 6A–6C. Gas flows 88 and 90 and polymer flow 92 are the same as those shown in FIGS. 6A–6C except that the first gas flow 88 and the second gas flow 90 discharge synchronously rather than alternately. For example, FIG. 7A shows both first gas flow 88 and second gas flow 90 discharging simultaneously from the first primary gas flow slot 84 and second primary gas flow slot 86, respectively. FIG. 7B shows an interruption in gas flow wherein no gas is discharging from gas flow slots 84 and 86. FIGS. 7A and 7B together constitute a single pulsation cycle. FIG. 7C represents initiation of another cycle with gas discharging synchronously from the first primary gas flow slot 84 and the second primary gas flow slot 86.

One Constant Primary Gas Flow with Pulsating Second Primary Flow

Figure 8A:
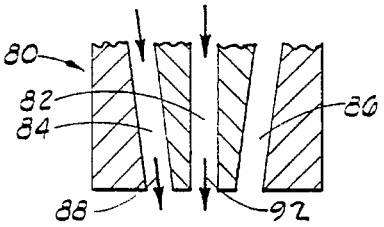
FIGS. 8A–8C is a cross-sectional view of one constant primary gas flow with pulsating second primary flow.
Figure 8B:
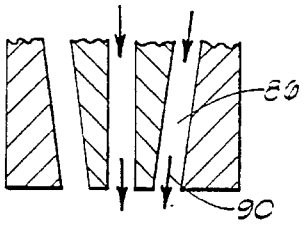
Figure 8C:
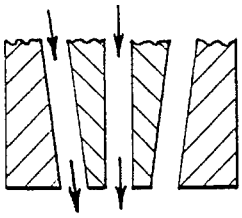

Shown in FIGS. 8A–8C is a melt blowing die 80 which is exactly the same as the melt blowing die 80 shown in FIGS. 6A–6C. Gas flows 88 and 90 and polymer flow 92 are the same as those shown in FIGS. 6A–6C except that one of the primary gas flows is a pulsating flow while the second primary gas flow is a continuous flow. For example, FIG. 8A shows both first gas flow 88 and second gas flow 90 discharging from the first primary gas flow slot 84 and second primary gas flow slot 86, respectively. FIG. 7B shows an interruption in the first gas flow 88 while the second gas flow 90 continues. FIGS. 8A and 8B together constitute a single pulsation cycle. FIG. 8C represents initiation of another cycle with gas discharging synchronously from both the first primary gas flow slot 84 and the second primary gas flow slot 86.

Pulsation in Slot Dies with Segregated Gas Flow Zones

Shown in FIG. 9 is a slotted melt blowing die designated by the general reference numeral 100. The die 100 has a row of polymer flow channels 102 and in this way is similar to a conventional melt blowing die. Flanking the plurality of channels 102 is a series of primary gas flow zones. The gas discharge from each of the zones can be controlled independently of each of the others. On one side of the channels 102 is a first primary gas flow zone 104 ("Zone I"), a second primary gas flow zone 106 ("Zone II"), a third primary gas flow zone 108 ("Zone III"), and a fourth primary gas flow zone 110 ("Zone IV"). On the opposite side of the channels 102 is a fifth primary gas flow zone 112 ("Zone V"), a sixth primary gas flow zone 114 ("Zone VI"), a seventh primary gas flow zone 116 ("Zone VII"), and an eighth primary gas flow zone 118 ("Zone VIII"). In the version described herein, the gas flow zones are configured such that the Zone I is opposite the Zone V, Zone II is opposite Zone VI, Zone III is opposite Zone VII, and Zone IV is opposite Zone VIII as shown in FIG. 9.

Given the zonal configuration of the die 100 shown in FIG. 9, one of ordinary skill in the art will be able to contemplate a multitude of pulsation sequences which could be employed during the melt blowing operation. For illustration, several examples of pulsation sequences are provided in Table 1.

TABLE 1

Sequence of Zonal Discharge in One Cycle - Slot Die

| SEQUENCE NO. | ORDER OF DISCHARGE |
|---|---|
| A | I and III; V and VII; II and IV; VI and VIII |
| B | I and V; II and VI; III and VII; IV and VIII |
| C | I and VI; III and VIII; II and V; IV and VII |
| D | I and II; V and VI; III and IV; VII and VIII |
| E | I and VI; II and V; III and VIII; IV and VII |
| F | I and II; III and IV; V and VI; VII and VIII |
| G | I and III; VI and VIII; II and IV; V and VII |
| H | I; VI; III; VIII; V; II; VII; IV |
| I | I; V; II; VI; III; VII; IV; VIII |
| J | I, VI, III and VIII; V, II, VII and IV |
| K | I, V, III and VII; II, VI, IV and VIII |

As shown by the examples in Table 1, the potential sequences which could be employed are virtually endless. Sequence A shows a pulsation cycle in which zones I and III initiate the cycle by simultaneously discharging gas first. After discharging for a predetermined length of time zones I and III then shut down and are followed by the simultaneous discharging of zones V and VII. After a predetermined time which may or may not be the same length of discharging time as the discharging time of zones I and III, zones V and VII shut down and are followed in turn by zones II and IV, and these by zones VI and VIII. Sequence H of Table 1 shows a discharge sequence in which zone I discharges first, zone VI discharges second, zone III discharges third, zone VIII discharges fourth, zone V discharges fifth, zone II discharges sixth, zone VII discharges seventh and zone IV discharges eighth. This entire sequence comprises one pulsation cycle. The next cycle begins when zone I again discharges. Sequence K of Table 1 shows yet another possible pulsation sequence wherein zones I, V, III and VII discharge synchronously. When zones I, V, III and VII cease discharging, zones II, VI, IV and VIII begin discharging until the end of the cycle when II, VI, IV and VIII shut down.

It is also possible to contemplate versions of the present invention in which gas from a subset of the eight zones, for example zones I, VI, III and VIII, discharges continuously while the remaining zones discharge pulsatingly in some predetermined sequence. It is also possible to contemplate versions of the present invention in which variations in the cycle frequency are superimposed upon the discharge sequence. It is also possible to contemplate versions of the present invention in which different discharge sequences alternate in a secondary discharge sequence. For example, sequence H may alternate with sequence I ("H-I, H-I, H-I . . . ") or sequence A may alternatingly alternate with sequences B and C ("A-B, A-C, A-B, A-C, . . . ").

It will be understood by one of ordinary skill in the art that the eight-zone configuration described herein is only illustrative and that any number of other zonal gas flow configurations can be contemplated. For example, instead of 8 zones, there could instead be any multiple of two from 4 to 64, or even greater. It can also be contemplated that there could be an odd number of zones, or that the gas flow zones on opposite sides of the channels 102 could be staggered rather than directly opposite one another.

Embodiments with Secondary Gas Flows

Besides pulsating the primary gas flow in a melt blowing die, secondary gas streams can be applied to the operation and can even be pulsated. One well known arrangement for secondary gas flow in melt blowing is provided in U.S. Pat. No. 4,622,259 cited above. A pulsating flow pattern can be imposed on the secondary flow to increase the efficiency of melt blowing. In fact, combinations of primary and secondary flow pulsation can also be used as will be described in further detail below. In FIGS. 10A–19C the angle at which the secondary gas flow is directed toward the polymer stream is shown as approximately 90°. However, in actuality the angle can range from about 0° to about 180°.

Alternately Pulsating Primary Flow with Continuous Secondary Flow

Figure 10A:
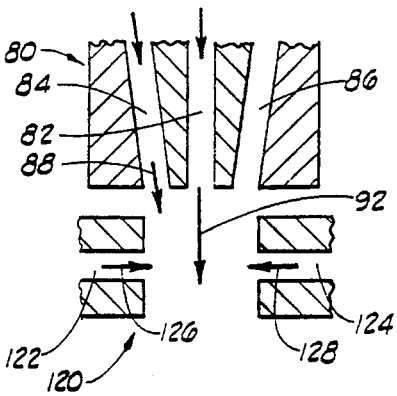
FIGS. 10A–10C is a cross-sectional view of an alternately pulsating primary flow with continuous secondary flow.
Figure 10B:
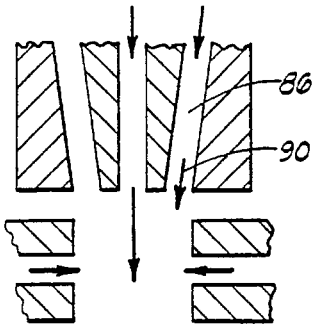
Figure 10C:
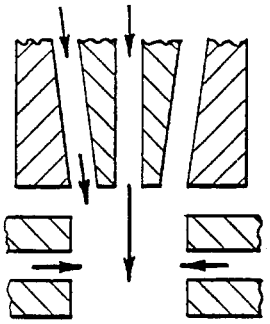
Figures 8A, 8B, 8C:
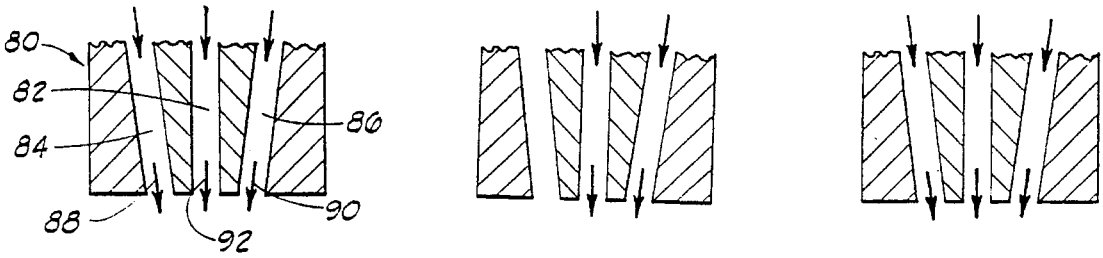

Shown in FIGS. 10A–10C is a melt blowing die designated by the general reference numeral 80. The die 80 is exactly the same as die 80 in FIGS. 6A–6C, the die 80 having a plurality of polymer flow channels, one of which is shown as polymer flow channel 82. The die 80 further has a first primary gas flow slot 84, and a second primary gas flow slot 86 and a first gas flow 88 which discharges from the first primary gas flow slot 84 and a second gas flow 90 which discharges from the second primary gas flow slot 86. Also shown in the version of the present invention shown in FIGS. 10A–10C is a secondary gas flow assembly 120 which comprises a first secondary gas flow slot 122 and a second secondary gas flow slot 124. A first secondary gas flow 126 is discharged from the first secondary gas flow slot 122 while a second secondary gas flow 128 is discharged from the second secondary gas flow slot 124 in a manner well known to those of ordinary skill in the art.

In the version of the present invention shown in FIGS. 10A–10C, the primary gas flow alternatingly pulsates in exactly the same manner and sequence as that shown in FIGS. 6A–6C except that secondary gas flows 126 and 128 flow continuously through secondary gas flow slots 122 and 124, respectively, while the polymer flow 92 flows continuously through the polymer flow channel 82. FIGS. 10A and 10B represent one complete pulsation cycle. FIG. 10C represents the initiation of another cycle wherein the first gas flow 88 resumes.

Synchronously Pulsating Primary Flow with Continuous Secondary Flow

Figure 11A:
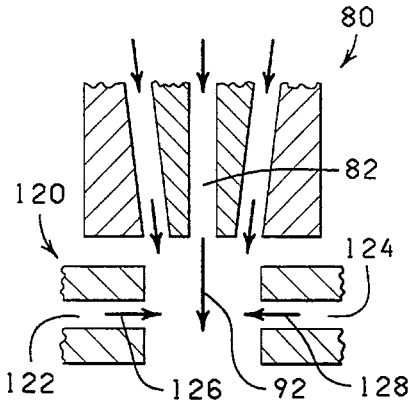
FIGS. 11A–11C is a cross-sectional view of a synchronously pulsating primary flow with continuous secondary flow.
Figure 11B:
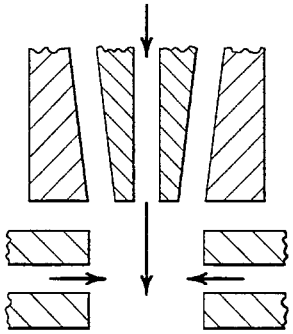
Figure 11C:
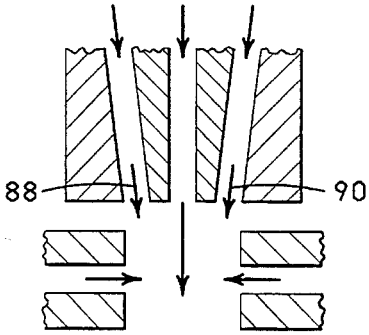

Shown in FIGS. 11A–11C is a die 80 which is exactly the same as die 80 in FIGS. 10A–10C, except in the version of the present invention shown in FIGS. 11A–11C, the primary gas flow synchronously pulsates rather than alternatingly pulsates. The primary gas flow synchronously pulsates in exactly the same manner and sequence as that shown in FIGS. 7A–7C except that secondary gas flows 126 and 128 discharge continuously from secondary gas flow slots 122 and 124, respectively, while the polymer flow 92 discharges continuously from the polymer flow channel 82. FIGS. 11A and 11B represent one complete pulsation cycle. FIG. 11C represents the initiation of another cycle wherein the first gas flow 88 and second gas flow 90 resumes.

Continuous Primary Flow with Alternately Pulsating Secondary Flow

Figure 12A:
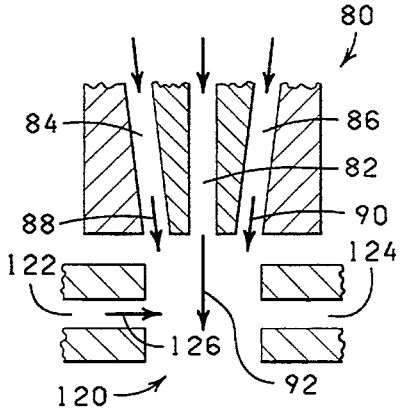
FIGS. 12A–12C is a cross-sectional view of a continuous primary flow with alternately pulsating secondary flow.
Figure 12B:
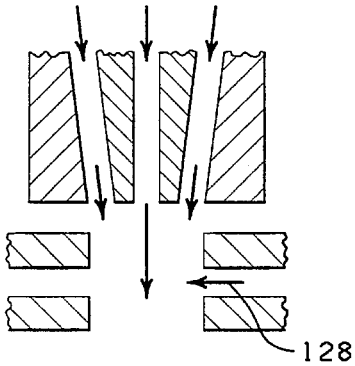
Figure 12C:
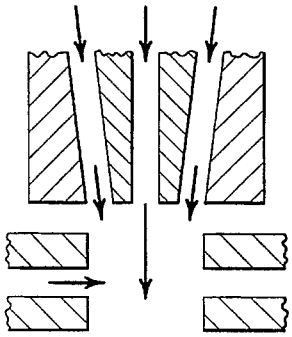

Shown in FIGS. 12A–12C is a melt blowing die 80 which is exactly the same as die 80 in FIGS. 10A–10C and which also has a secondary gas flow assembly 120 having a first secondary gas flow slot 122 and a second secondary gas flow slot 124 exactly the same as the secondary gas flow assembly 120 in FIGS. 10A–10C.

In the version of the present invention shown in FIGS. 12A–12C, the first primary gas flow 88 and the second primary gas flow 90 discharge continuously rather than pulsatingly. It is the secondary gas flows 126 and 128 which pulsatingly discharge from secondary gas flow slots 122 and 124, respectively, while the polymer flow 92 discharges continuously from the polymer flow channel 82. As shown in FIG. 12A, the secondary gas flows 126 and 128 alternately pulsatingly discharge from secondary gas flow slots 122 and 124, respectively, while the polymer flow 92 discharges continuously from the polymer flow channel 82 and gas is continuously discharged through primary gas flow slots 84 and 86. As shown in FIG. 12B, gas flow through the primary gas flow slots 84 and 86 continues while gas discharge from the secondary gas flow slots 122 and 124 is interrupted. FIG. 12C then shows resumption of the gas flow through the secondary gas flow slots 122 and 124. FIGS. 12A and 12B represent one complete pulsation cycle in which the secondary gas flows 126 and 128 flow alternatingly while the primary gas flows 88 and 90 flow continuously.

Continuous Primary Flow with Synchronously Pulsating Secondary Flow

Figure 13A:
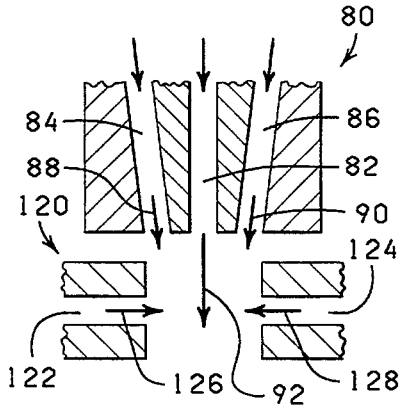
FIGS. 13A–13C is a cross-sectional view of a continuous primary flow with synchronously pulsating secondary flow.
Figure 13B:
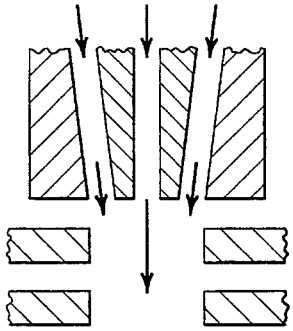
Figure 13C:
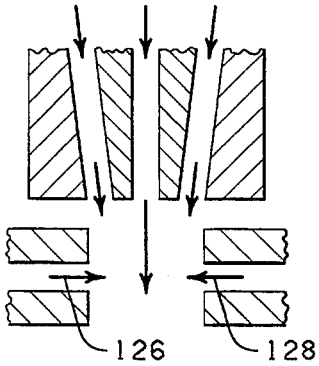

Shown in FIGS. 13A–13C is a melt blowing die 80 which is exactly the same as die 80 in FIGS. 10A–10C and which also has a secondary gas flow assembly 120 having a first secondary gas flow slot 122 and a second secondary gas flow slot 124 exactly the same as the secondary gas flow assembly 120 in FIGS. 10A–10C.

In the version of the present invention shown in FIGS. 13A–13C, the first primary gas flow 88 and the second primary gas flow 90 discharge continuously rather than pulsatingly. As shown in FIG. 13A, the secondary gas flows 126 and 128 synchronously pulsatingly discharges from secondary gas flow slots 122 and 124, respectively, while the polymer flow 92 discharge continuously from the polymer flow channel 82 and gas is continuously discharged from primary gas flow slots 84 and 86. As shown in FIG. 13B, gas flow from the primary gas flow slots 84 and 86 continues while gas discharge from the secondary gas flow slots 122 and 124 is interrupted. FIGS. 12A and 12B represent one complete pulsation cycle in which the secondary gas flows 126 and 128 synchronously pulsate while the primary gas flows 88 and 90 flow continuously.

Figure 14A:
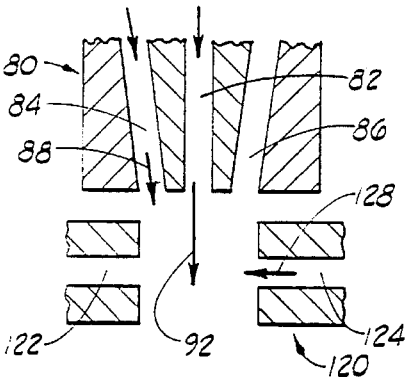
FIGS. 14A–14C is a cross-sectional view of an alternately pulsating primary flow with opposing alternately pulsating secondary flow.
Figure 14B:
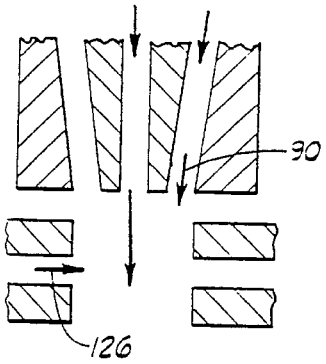
Figure 14C:
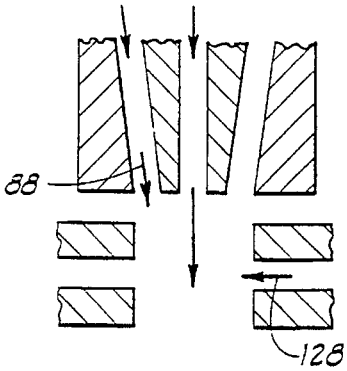

Alternately Pulsating Primary Flow with Opposing Alternately Pulsating Secondary Flow Shown in FIGS. 14A–14C is a melt blowing die 80 and secondary gas flow assembly 120 which is exactly the same as die 80 and secondary gas flow assembly 120 in FIGS. 10A–10C.

In the version of the present invention shown in FIGS. 14A–14C, the primary gas flows 88 and 90 alternatingly pulsate in exactly the same manner and sequence as that shown in FIGS. 10A–10C. The secondary gas flows 126 and 128 discharge exactly the same as in FIGS. 10A–10C except in the version shown in FIGS. 14A–14C, the secondary gas flows 126 and 128 have an alternately pulsating discharge rather than a continuous flow.

FIGS. 14A and 14B represent one complete pulsation cycle. FIG. 14A shows first primary gas flow 88 discharging synchronously with second secondary gas flow 128 while no gas is discharging from either second primary gas flow slot 86 or first secondary gas flow slot 122. Thus the primary gas flow opposes the secondary gas flow. FIG. 14B shows a reversal of the gas flow represented in FIG. 14A, wherein second primary gas flow 90 discharges synchronously with first secondary gas flow 126 while no gas is discharging from either the first primary gas flow slot 84 or the second secondary gas flow slot 124. The opposing nature of the primary and secondary gas flows is maintained. FIG. 14C represents the initiation of another cycle.

Figure 15A:
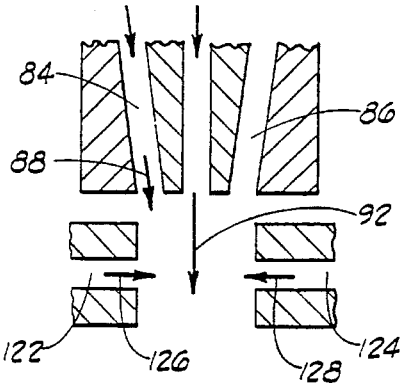
FIGS. 15A–15C is a cross-sectional view of an alternately pulsating primary flow with adjacent alternately pulsating secondary flow.
Figure 15B:
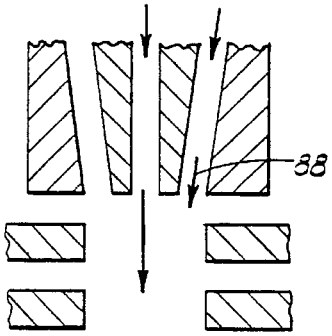
Figure 15C:
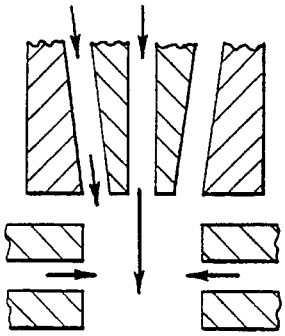

Alternately Pulsating Primary Flow with Adjacent Alternately Pulsating Secondary Flow Shown in FIGS. 15A–15C is a melt blowing die 80 and secondary gas flow assembly 120 which is exactly the same as die 80 and secondary gas flow assembly 120 in FIGS. 14A–14C.

In the version of the present invention shown in FIGS. 15A–15C, the primary gas flows 88 and 90 alternatingly pulsate in exactly the same manner and sequence as that shown in FIGS. 14A–14C. The secondary gas flows 126 and 128 also alternately pulsate. However, in the version shown in FIGS. 15A–15C, the secondary gas flows 126 and 128 pulsate synchronously with the adjacent primary gas flow 88 and 90, respectively, rather than with the opposing primary gas flow as was the case in the embodiment of FIGS. 14A–14C.

FIGS. 15A and 15B represent one complete pulsation cycle. FIG. 15A shows first primary gas flow 88 discharging synchronously with first secondary gas flow 126 while no gas is discharging from either the second primary gas flow slot 86 or second secondary gas flow slot 124. FIG. 15B shows a reversal of the gas flow represented in FIG. 15A wherein second primary gas flow 90 discharges synchronously with the second secondary gas flow 128 while no gas discharges from either first primary gas flow slot 84 or first secondary gas flow slot 122. FIG. 15C represents the initiation of yet another cycle.

Alternately Pulsating Primary Flow with Synchronously Pulsating Secondary Flow

Figure 16A:
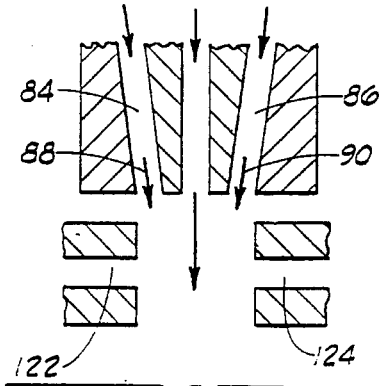
FIGS. 16A–16C is a cross-sectional view of an alternately pulsating primary flow with synchronously pulsating secondary flow.
Figure 16B:
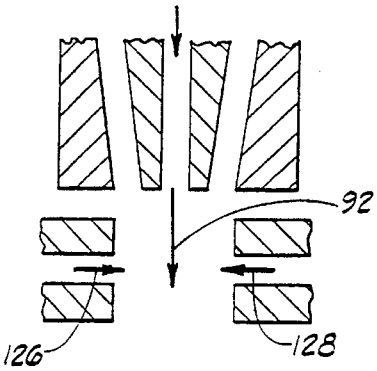
Figure 16C:
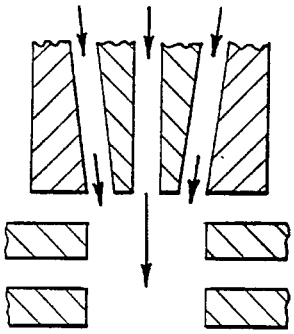
Figure 15A:
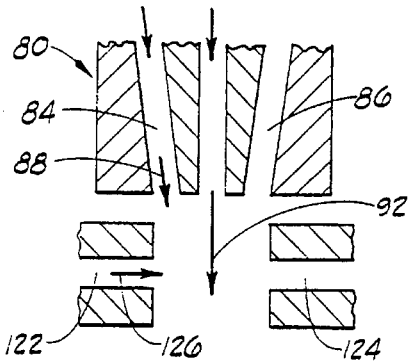
Figure 15B:
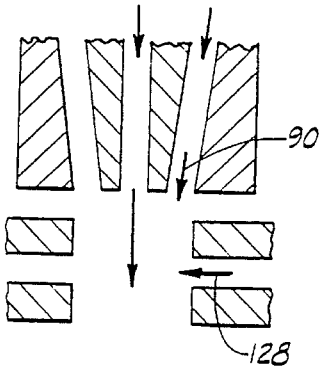
Figure 15C:
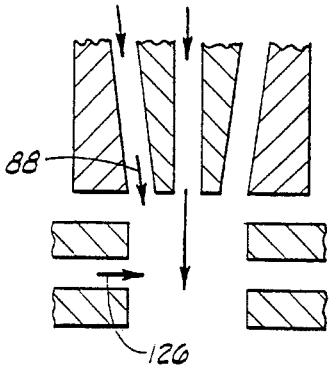

Shown in FIGS. 16A–16C is a melt blowing die 80 and secondary gas flow assembly 120 which is exactly the same as die 80 and secondary gas flow assembly 120 in FIGS. 14A–14C.

In the version of the present invention shown in FIGS. 16A–6C, the primary gas flows 88 and 90 alternatingly pulsate in exactly the same manner and sequence as that shown in FIGS. 14A–14C, while the secondary gas flows 126 and 128 synchronously pulsate in the same manner as in the version shown in FIGS. 13A–13C.

FIGS. 16A and 16B represent one complete pulsation cycle. FIG. 16A shows first primary gas flow 88 discharging synchronously with the synchronously discharging first secondary gas flow 126 and second secondary gas flow 128. No gas is discharging from second primary gas flow slot 86. FIG. 15B shows a second primary gas flow 90 discharging while no gas is discharging from either first primary gas flow slot 84 or the secondary gas flow slot 122 or 124. FIG. 16C represents the initiation of yet another cycle. Obviously, the same effect could be obtained if it was the second primary gas flow 90 discharging synchronously with the secondary gas flows 126 and 128.

Figure 17A:
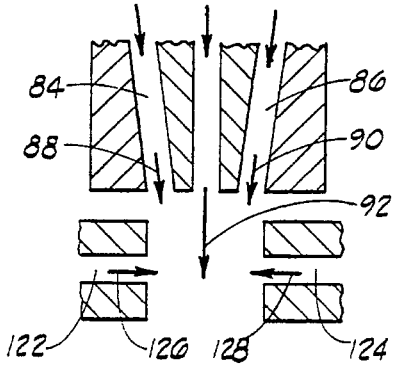
FIGS. 17A–17C is a cross-sectional view of a synchronously pulsating primary flow with synchronous synchronously pulsating secondary flow.
Figure 17B:
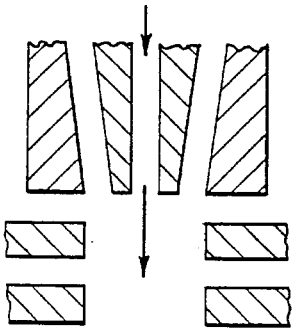
Figure 17C:
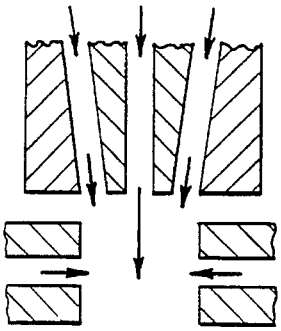
Figure 21:
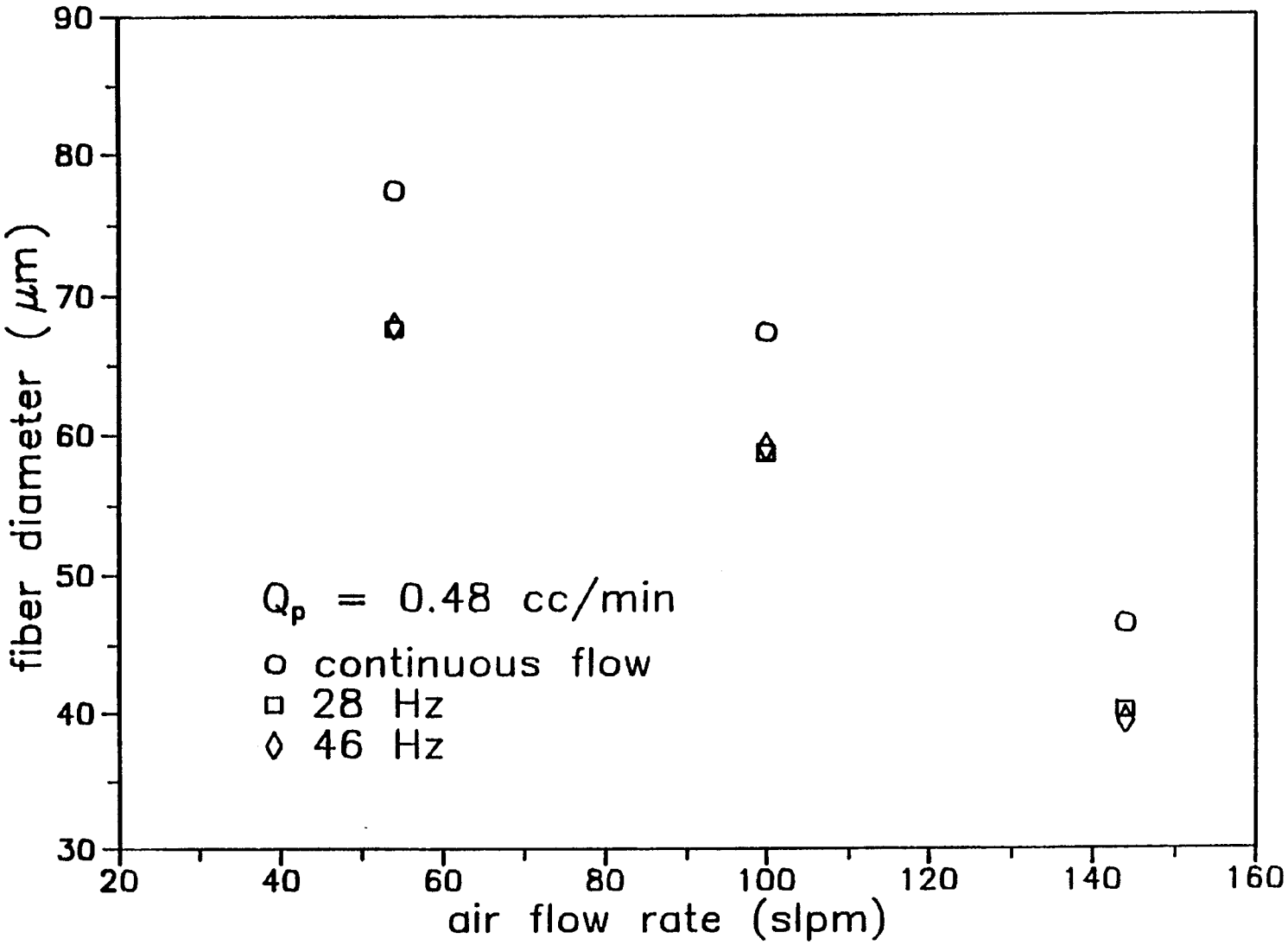
FIG. 21 is a graph of fiber diameters produced under a range of SLPM and pulsation rates.
Figure 22:
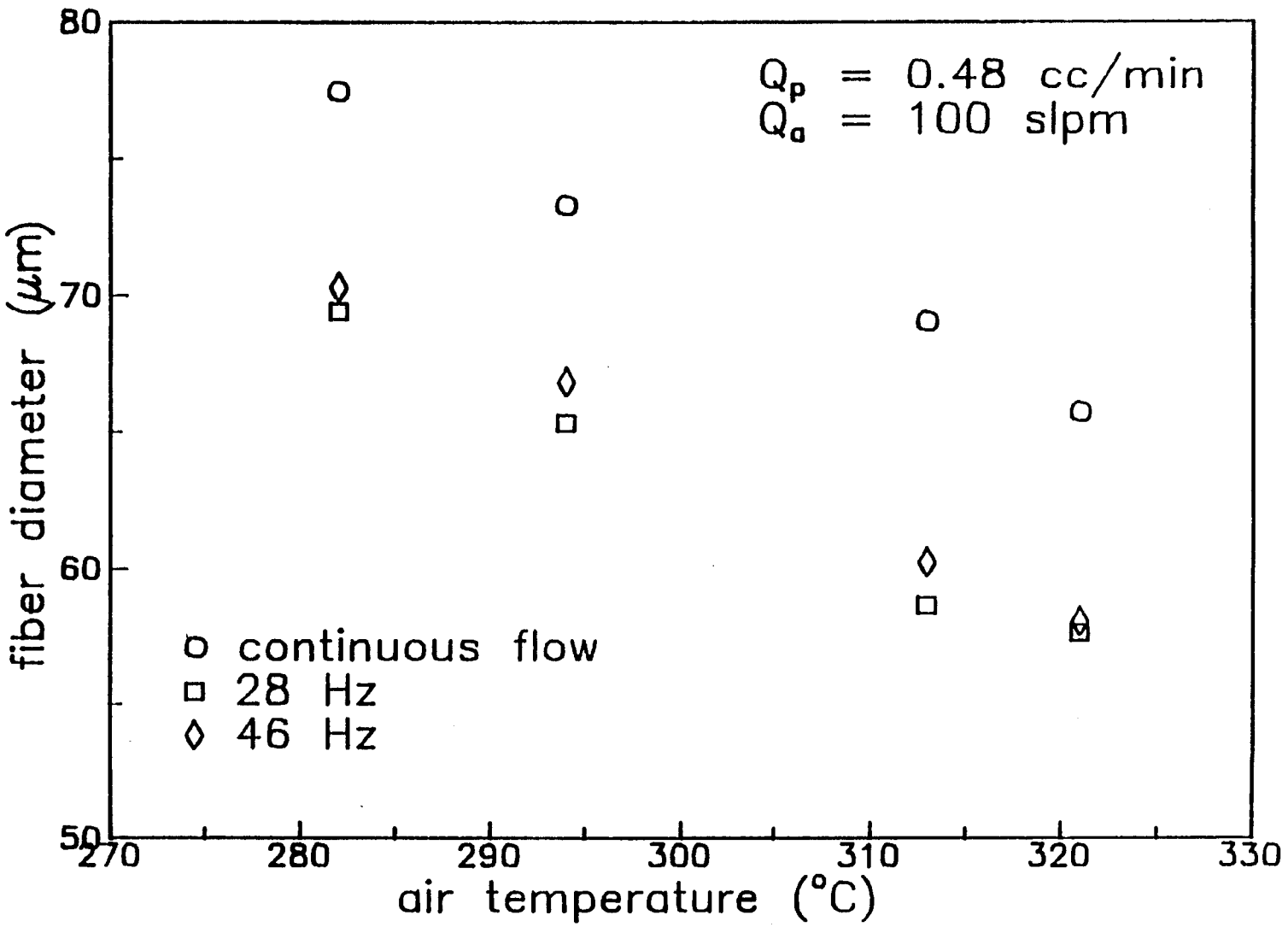
FIG. 22 is a graph of fiber diameters produced under a range of air temperatures and pulsation rates.
Figure 23:
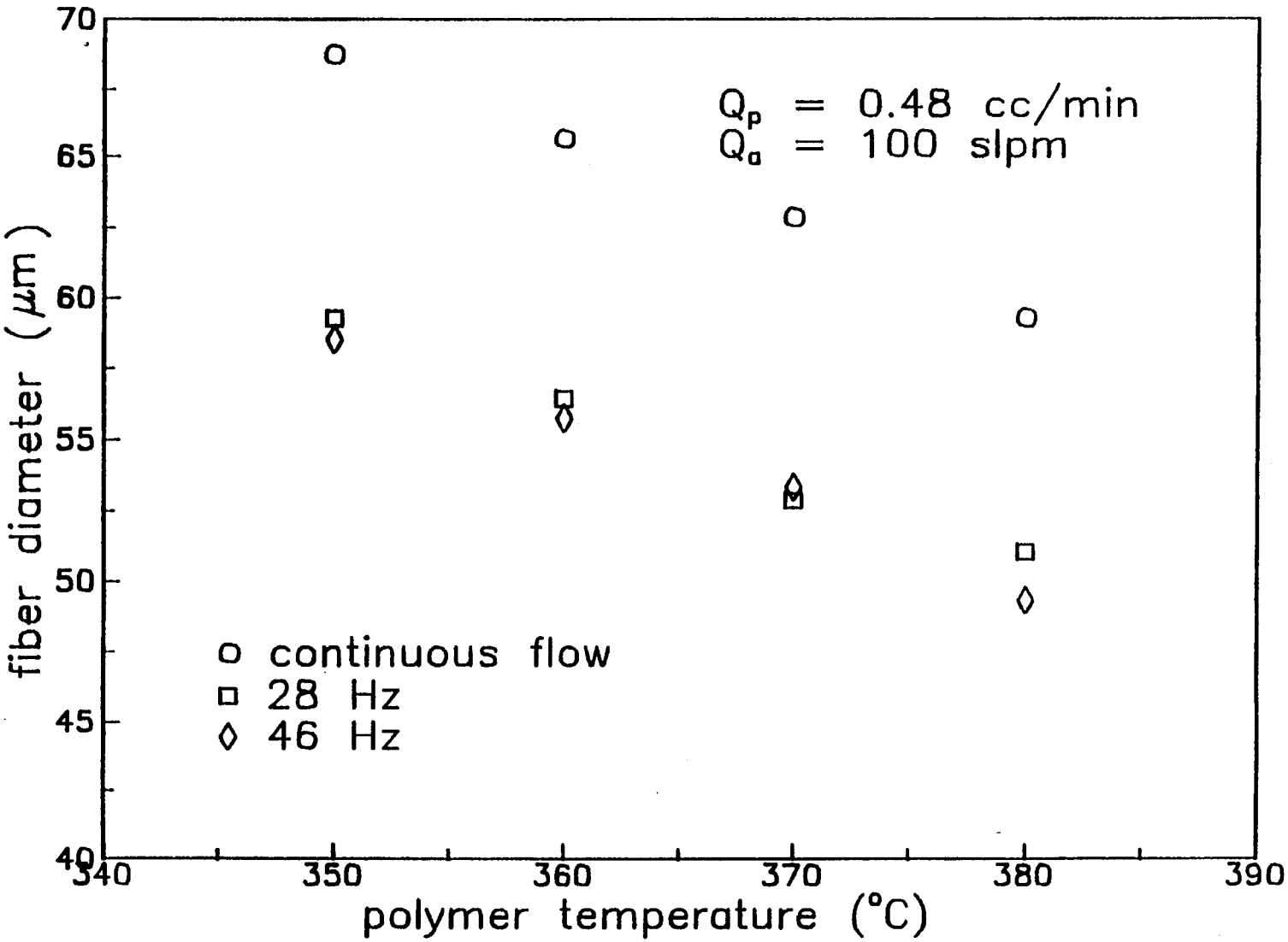
FIG. 23 is a graph of fiber diameters produced under a range of polymer temperatures and pulsation rates.
Figure 24:
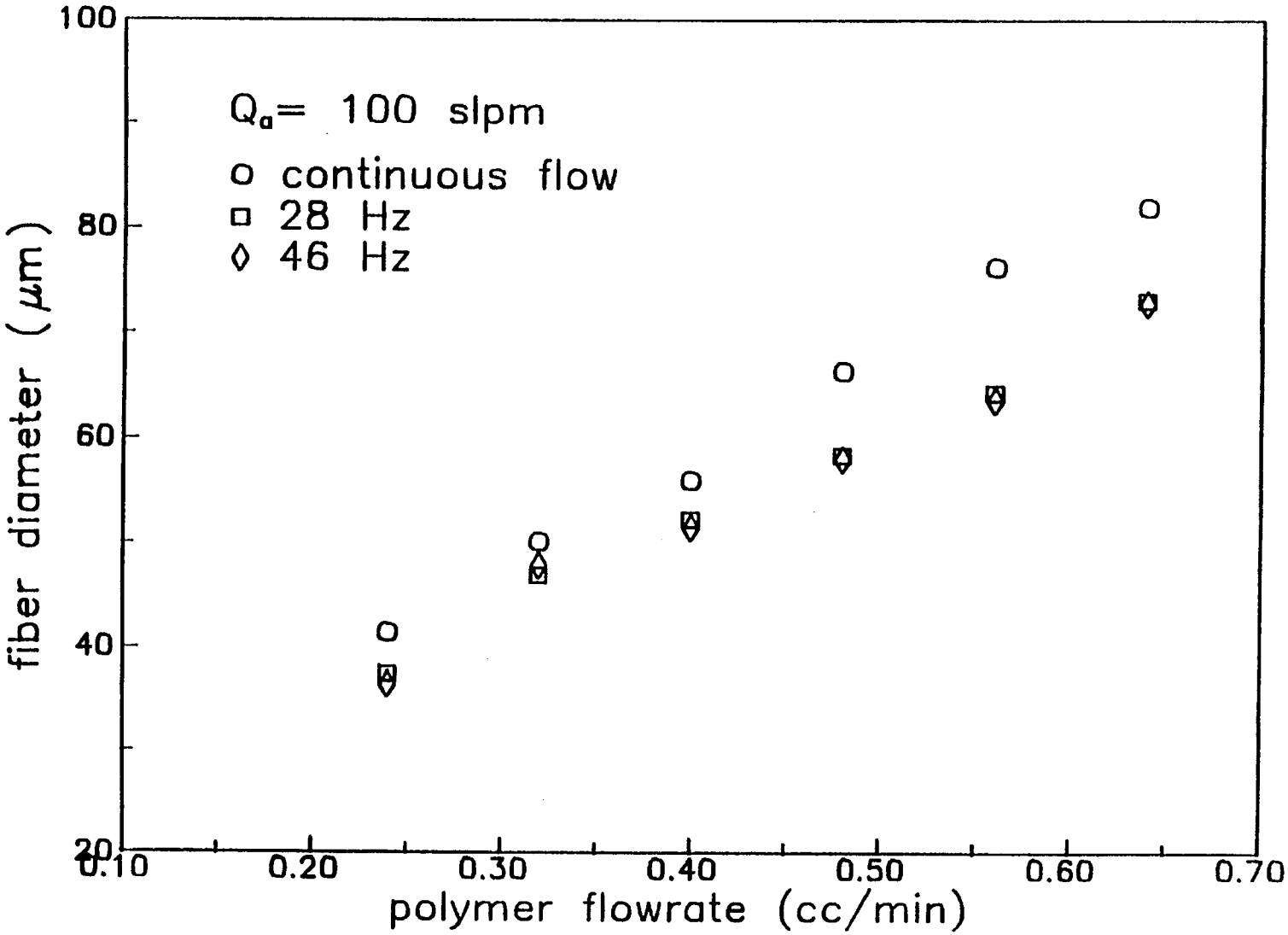
FIG. 24 is a graph of fiber diameters produced under a range of polymer flowrates and pulsation rates.

Synchronously Pulsating Primary Flow with Synchronous Synchronously Pulsating Secondary Flow Shown in FIGS. 17A–17C is a melt blowing die 80 and secondary gas flow assembly 120 which is exactly the same as die 80 and secondary gas flow assembly 120 in FIGS. 14A–14C.

In the version of the present invention shown in FIGS. 17A–17C, the primary gas flows 88 and 90 synchronously pulsate in exactly the same manner and sequence as that shown in FIGS. 11A–11C, while the secondary gas flows 126 and 128 synchronously pulsate in the same manner as in the version shown in FIGS. 13A–13C. In the version of the invention as embodied in FIGS. 17A–17C the synchronously discharging primary gas flows 88 and 90 are in synchrony with the synchronously discharging secondary gas flows 126 and 128.

FIGS. 17A and 17B represent one complete pulsation cycle. FIG. 17A shows first primary gas flow 88 discharging synchronously with the second primary gas flow 90. The first secondary gas flow 126 is also discharging synchronously with the second secondary gas flow 128. As indicated also gas flows 88, 90, 126 and 128 are discharging simultaneously. As indicated in FIG. 17B, no gas is discharging from any of primary gas flow slots 84 or 86 or from secondary gas flow slots 122 or 124. FIG. 17C represents the initiation of yet another cycle wherein gas flows 88, 90, 126 and 128 are discharging simultaneously.

Figures 18A, 18B, 18C:
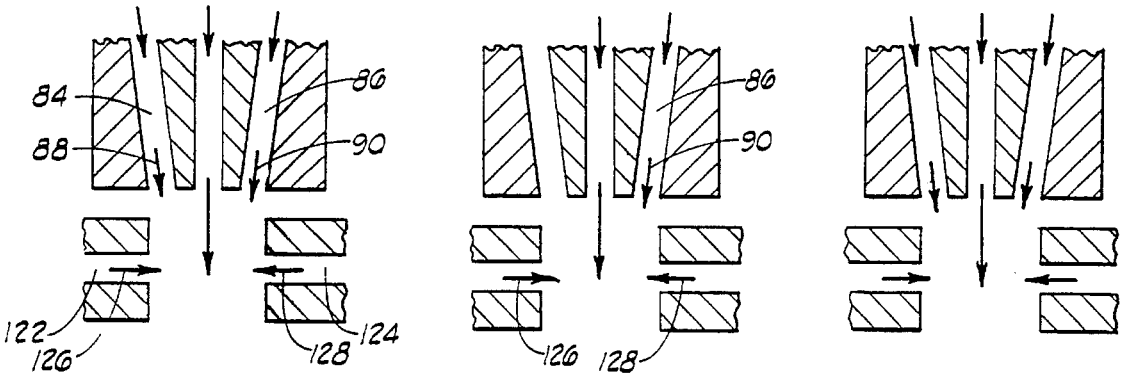
FIGS. 18A–18C is a cross-sectional view of a synchronously pulsating primary flow with alternating synchronously pulsating secondary flow.
Figure 3:
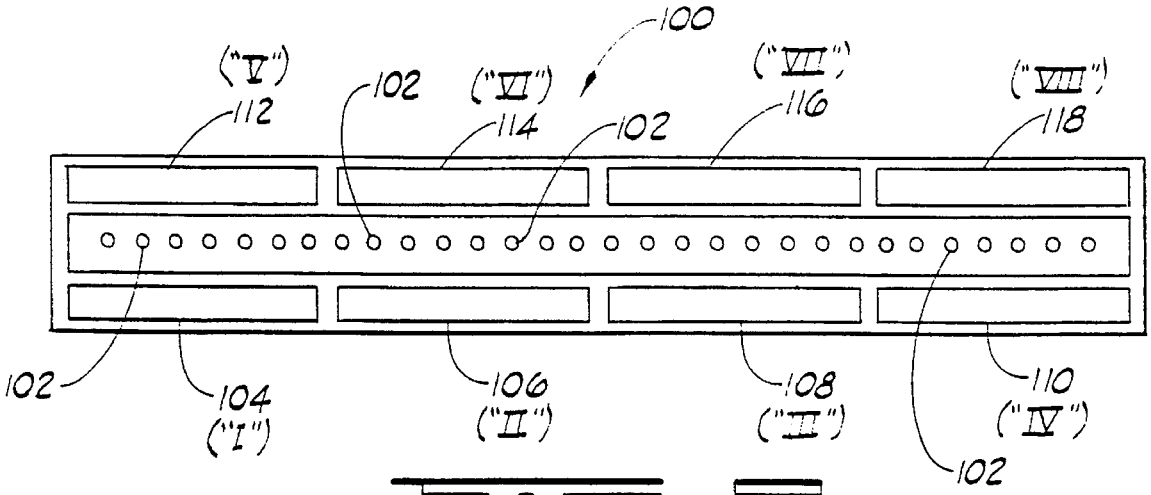

Synchronously Pulsating Primary Flows with Alternating Synchronously Pulsating Secondary Flows Shown in FIGS. 18A–18C is a melt blowing die 80 and secondary gas flow assembly 120 which is exactly the same as die 80 and secondary gas flow assembly 120 in FIGS. 14A–14C.

In the version of the present invention shown in FIGS. 18A–18C, the primary gas flows 88 and 90 synchronously pulsate in exactly the same manner and sequence as that shown in FIGS. 11A–11C, while the secondary gas flows 126 and 128 synchronously pulsate in the same manner as in the version shown in FIGS. 13A–13C with the exception of that shown herein. In the version of the invention as embodied in FIGS. 18A–18C the synchronously discharging primary gas flows 88 and 90 alternate with the synchronously discharging secondary gas flows 126 and 128.

FIGS. 18A and 18B represent one complete pulsation cycle. FIG. 18A shows first primary gas flow 88 discharging synchronously with the second primary gas flow 90. However, no gas is being discharged from either of secondary gas flow slots 122 or 124. FIG. 18B shows first secondary gas flow 126 discharging synchronously with the second secondary gas flow 128. However, no gas is being discharged from either of primary gas flow slots 84 or 86. FIG. 18C represents the initiation of yet another cycle wherein primary gas flows 88 and 90 are discharging simultaneously while no secondary gas is being discharged.

One Constant Primary Gas Flow with Primary Flow with Continuous Secondary Flow

Shown in FIGS. 19A–19C is a melt blowing die 80 and secondary gas flow assembly 120 which is exactly the same as die 80 and secondary gas flow assembly 120 in FIGS. 14A–14C.

In the version of the present invention shown in FIGS. 19A–19C, the primary gas flows 88 and 90 pulsate in exactly the same manner and sequence as that shown in FIGS. 8A–8C, while the secondary gas flows 126 and 128 discharge continuously in exactly the same manner as in the version shown in FIGS. 10A–10C. In the version of the invention as embodied in FIGS. 19A–19C the embodiment of the primary gas flow of FIGS. 8A–8C is superimposed upon the embodiment of the secondary gas flow of FIGS. 10A–10C.

Figure 20:
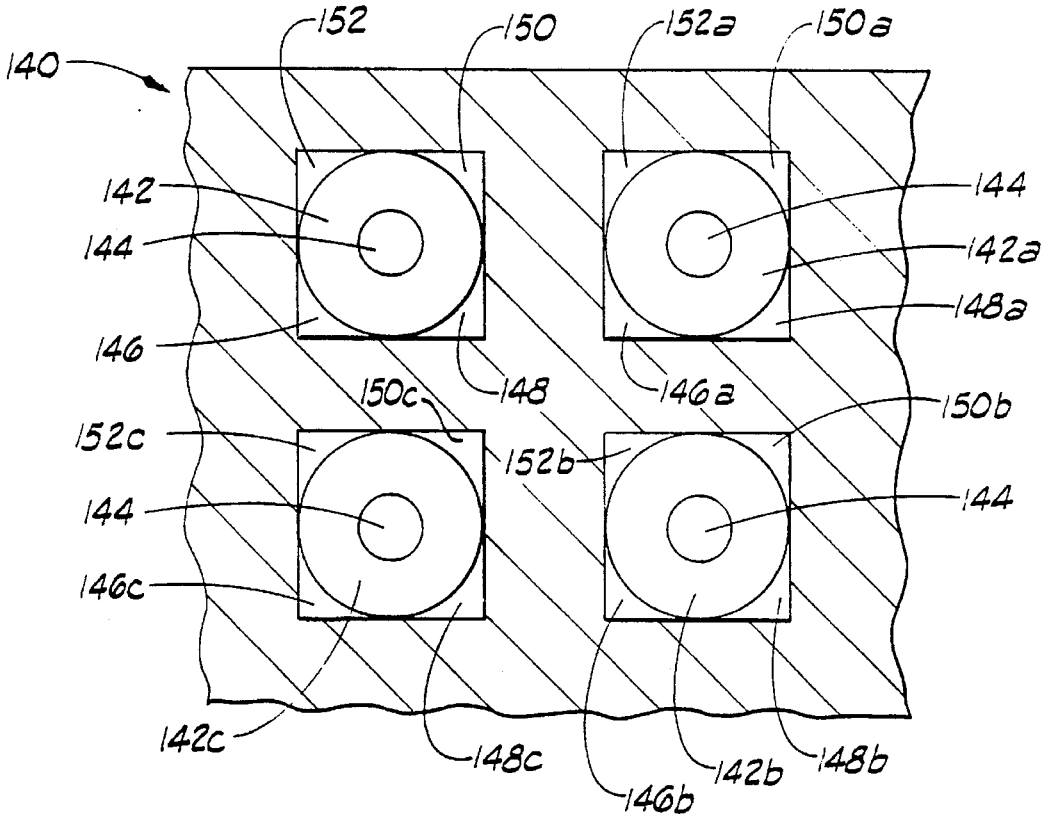
FIG. 20 is a bottom plan view of an annular die, wherein four jets are visible.

FIGS. 19A and 19B represent one complete pulsation cycle. FIG. 19A shows both first and second primary gas flows 88 and 90 discharging synchronously with the first and second secondary gas flows 126 and 128. In other words, there is complete gas discharge from all gas slots. In FIG. 19B, in the next stage of the cycle, gas discharge from the second primary gas flow slot 86 continues, as does gas discharge from both the first and second secondary gas flow slots 122 and 124. However, no gas is being discharged from the first primary gas flow slot 84. FIG. 19C represents the initiation of yet another cycle wherein primary gas flows 88 and 90 and secondary gas flows 126 and 128 are again discharging. Obviously, in FIG. 19B, the non-discharging slot could be the second primary gas flow slot 86 rather than the first primary gas flow slot Use of Dies with Annular Jets Each of the embodiments of the present invention contemplated above is adaptable for dies using annular jet configurations. Dies with annular jets are described in detail in U.S. Pat. No. 4,380,570 cited above. A die designated by the general reference numeral 140 which has one such type of annular jet is shown in FIG. 20. The die 140 has a plurality of annular jets. Die 140 indicated in FIG. 20 has four such jets designated as jets 142, **142*a*, 142*b* and 142*c*. Each jet 142–142*c* has an orifice 144 through which polymer flows. Each jet 142–142*c* is flanked by four apertures through which gas flows during the melt blowing operation. Jet 142 has gas apertures 146, 148, 150 and 152. Jet 142*a* has apertures 146*a*, 148*a*, 150*a* and 152*a*. Jet 142*b* has apertures 146*b*, 148*b*, 150*b* and 152*b*. Jet 142*c* has apertures 146*c*, 148*c*, 150*c* and 152*c*. Each of these apertures serves as a separate gas discharge point for each jet in the die 140**. Other types of dies having other types of gas apertures can also be contemplated. For example, the apertures may be triangular, bimodal, hexagonal, pentagonal or any other geometric form. The jet orifices may also have shapes other than circular.

As shown above for the slot dies, a large number of discharge sequences are conceivable. Several examples of discharge sequences for pulsation cycles are given in Table 2. In the examples shown in Table 2, apertures set apart by commas are discharged simultaneously. Groupings of apertures set apart by semicolons are discharged in the order shown. For example in sequence No. A in Table 2, gas is discharged from apertures 146, **146*a*, 146*b* and 146*c* synchronously. This discharge is followed by the synchronous discharge from apertures 148, 148*a*, 148*b* and 148*c*. This in turn is followed by the synchronous discharge from apertures 150, 150*a*, 150*b* and 150*c*, which is followed by the synchronous discharge from apertures 152, 152*a*, 152*b* and 152*c***. This sequence comprises one discharge cycle and is followed by another cycle comprising the same discharge sequence.

In a number of possible embodiments of pulsation sequences (for example Sequence A in Table 2) the annular jet configuration could serve not only to attenuate the fibers to smaller diameters but could also impart a "swirl" to the laydown pattern of the mat produced from the fibers.

TABLE 2

Sequence of Zonal Discharge In One Cycle - Annular Die

| SEQUENCE NO. | ORDER OF DISCHARGE |
|---|---|
| A | 146, 146a, 146b and 146c; 148, 148a, 148b and 148c; 150, 150a, 150b and 150c; 152, 152a, 152b and 152c. |
| B | 146, 146a, 146b and 146c; 150, 150a, 150b and 150c; 148, 148a, 148b and 148c; 152, 152a, 152b and 152c. |
| C | 146, 148, 150 and 152; 146a, 148a, 150a and 152a; 146b, 148b, 150b and 152b; 146c, 148c, 150c and 152c. |
| D | 146, 146a, 146b and 146c; 150, 150a, 150b and 150c (other jets flow continuously). |
| E | 146, 152c, 148a and 150b; 148, 150c, 146a and 152b; 150, 148c, 152a and 142b; 152, 146c, 150a and 148b. |

It will be understood by one of ordinary skill in the art that for any of the methods discussed or contemplated above, the pulsation frequency could be altered during the polymer flow operation. It will also be understood by one of ordinary skill in the art that any number of combinations of pulsation methods could be superimposed upon one another. For example, an alternately pulsating primary gas flow could be alternated with a synchronously pulsating primary gas flow. Superimposed upon this combination could be alterations in the pulsation frequencies.

It will also be widely appreciated by those of ordinary skill in the art that the examples provided above are but a few of the possible sequential configurations of melt blowing operations using secondary gas flows. Especially when the segregated zone configurations discussed regarding the embodiments of FIG. 9 are included the potential versions of the invention become legion. Moreover, it will be understood that modifications in the cyclic frequencies can be superimposed upon the sequential configurations thus further multiplying the potential embodiments of the present invention.

It will also be understood by those of ordinary skill in the art that the terms alternate and synchronous as used above are only approximations and that in actuality the synchronicity between and among the various primary and secondary gas flows discussed above may range from completely synchronous to slightly asynchronous and from there to moderately asynchronous to completely asynchronous. For example, reference is made to the version of the present invention shown in FIGS. 14A–14B. The discharge of first primary gas flow 88 is shown as synchronous with the discharge of second secondary gas flow 128. But it will be appreciated that the discharge of the first primary gas flow 88 may occur slightly ahead of or even well in advance of the discharge of the second secondary gas flow 128. Similarly, the discharge of the first primary gas flow 88 may lag slightly or even be well behind of the discharge of the second secondary gas flow 128. The same can be said for the discharge of the second primary gas flow 90 and the discharge of the first secondary gas flow 126 shown in FIG. 14B. The same offsetting of discharges of primary and secondary gas flows may occur in any number of possible versions of the invention.

Furthermore, it will be understood by one of ordinary skill in the art that the time length and air volume rate may not be constant from one pulsation cycle to the next. For example, air volume rate may be 10 $ft.^3$/min. in one cycle, followed by 20 $ft^3$/min. in the next cycle. Air volume rate within a single pulsation cycle may also vary. Also, pulse duration during a single pulsation cycle may also vary. For example, a single cycle may comprise a quarter second pulse, followed by a quarter second period of zero air flow, followed by a half second pulse, followed by a half second period of zero air flow.

As noted above, the pulsation sequence of primary, secondary, tertiary or additional gas flows can impart a great diversity of patterns in the laydown of fibers comprising the mat. Certain pulsation modes may result in swirl patterns. Others may give rise to fiber patterns which impart a "knit" or "woven" appearance to the mat. These laydown patterns may affect not only the appearance of the mat but may increase the strength, elasticity and "bounce" of the mat.

Although the figures show a polymer stream extruded into open air, the die orifice may be recessed wherein the polymer stream is extruded into an internal cavity before it enters the open space above the fiber collection surface. This internal cavity into which the polymer is extruded affords the polymer stream an extended period of contact with the gas flow.

As described in Shambaugh, R. L., "A Macroscopic View of the Melt Blowing Process for Producing Microfibers", *Ind. Eng. Chem. Res.* 1988, 27(12), 2363–2372, there are three regions of melt blowing operation. In region I, the low gas velocity region, the fiber is continuous and the fiber motion is essentially parallel with the motion of the gas. As the gas velocity is increased, the process enters region II where the fiber breaks up into undesirable polymer lumps, or "shot". Finally, as the gas velocity is further increased, the shots become fine enough (shot diameters are $\leqq$0.3 mm) to be of little concern, and fiber diameters are very fine. Since shots are to be avoided, it would be of great value if the region transitions—in particular, the transition from region I to region II—could be predicted.

The present invention therefore also comprises a method for selecting the operating conditions in a melt blowing operation. In this method a mathematical model is provided which simulates a melt blowing process and which accounts for the transverse motion of fibers in the polymer stream, as described herein. A set of parameter values is provided and these are used in the model for generating a series of predictions as to which of the inputted parameter values lead to optimization of the melt blowing process. The subset of parameter values which optimizes the melt blowing operation can then be used in an actual melt blowing operation. In a particularly preferred version of the invention the set of parameter values comprises at least a pulsating gas flow rate.

Kayser and Shambaugh (1990) made use of dimensional analysis to correlate melt blowing behavior in region I melt blowing. Uyttendaele and Shambaugh ("Melt Blowing: General Equation Development and Experimental Verification. *AICHE J.*, 1990, 36(2), pp. 175–186.) developed a theoretical model for region I melt blowing. The Uyttendaele and Shambaugh model was based on a rigorous application of momentum, continuity, and energy equations. Both Newtonian and viscoelastic (Phan-Thien and Tanner) constitutive equations were used, and the predicted results compared favorably with actual experimental data. However, the Uyttendaele and Shambaugh model only considered the region I situation where the fiber moves parallel with the direction of the gas stream—no fiber vibrations (transverse motions) were considered. However, from experimental observations of the melt blowing process, it is known that transverse fiber motions become very pronounced as gas velocity is increased. Large amplitude vibrations are probably related to the transition from region I to region II.

MODEL FORMULATION

Most of the basic assumptions about the threadline are the same as those used previously to model region I melt blowing; see Uyttendaele and Shambaugh (1990). However, two of Uyttendaele and Shambaugh's assumptions were changed herein to the following: (a) the process is time dependent, and (b) the force exerted by the air on the fiber may have a component that is not parallel to the fiber axis.

Figure 25:
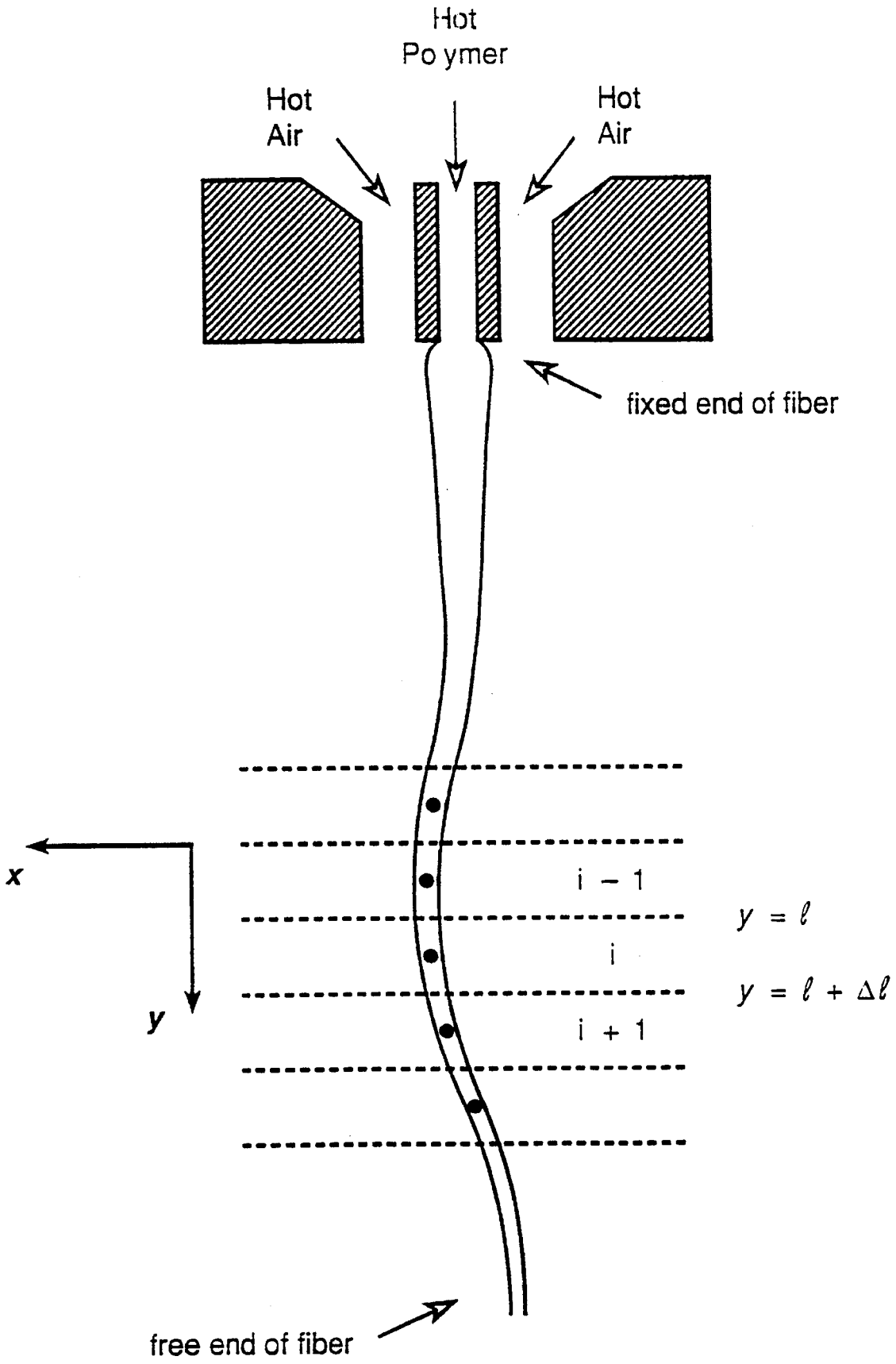
FIG. 25 is a diagram of a series of control volumes within a fiber stream.
Figure 26:
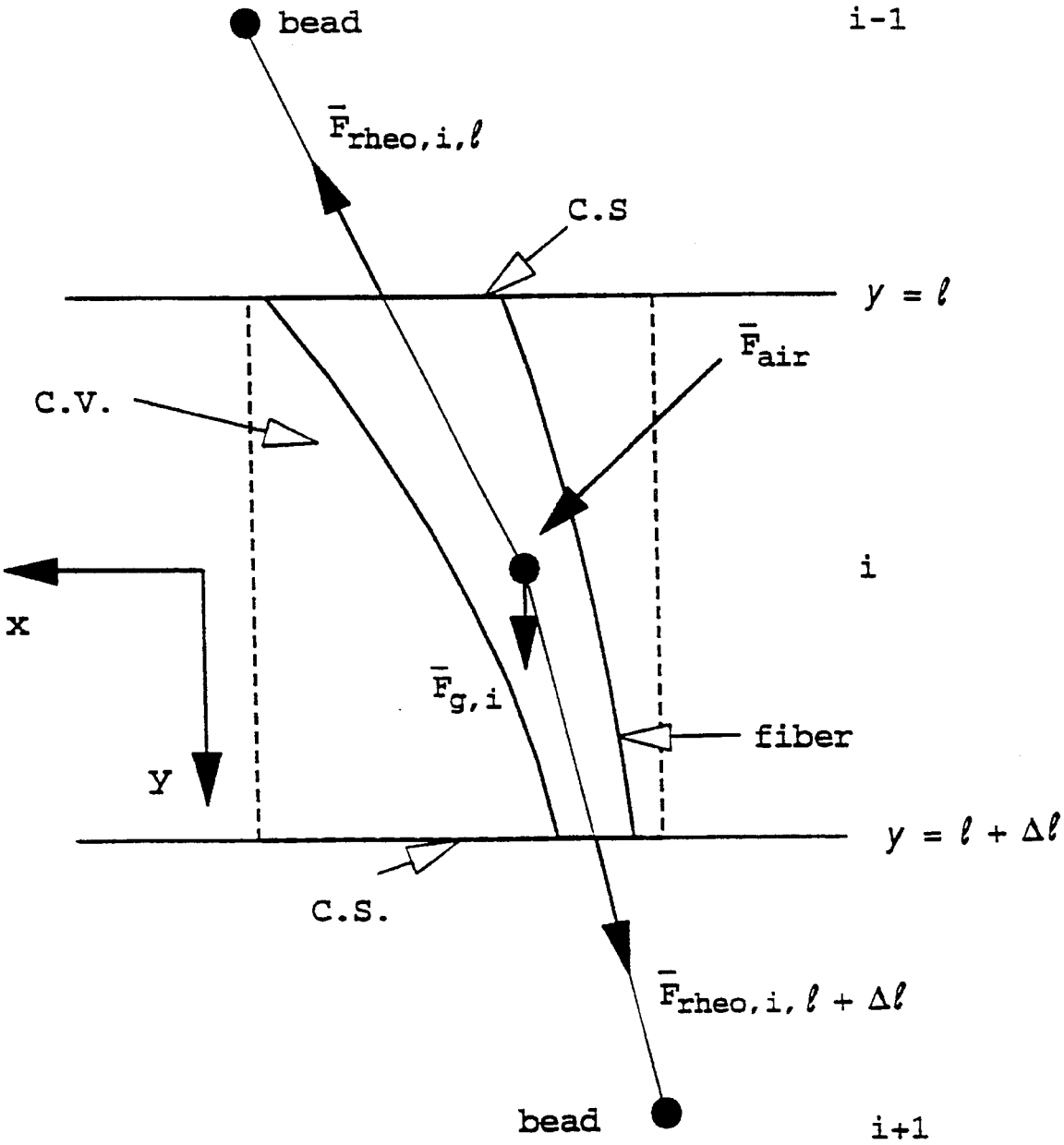
FIG. 26 is a diagram of a fiber element as it passes through a control volume.

FIG. 25 illustrates the more complex situation that we are modeling. Through the use of planes drawn perpendicular to the y-axis, the space below the die head is divided into a series of control volumes (c.v.). Each c.v. contains an element of the fiber; the mass of each element is assumed to be centered in a "bead" located at the center of the fiber element. Because of the motion of the fiber, the fiber can be oriented in any direction within each c.v.; in the x-direction, each c.v. is as large as is necessary to encompass the fiber element. The planes between adjacent control volumes are control surfaces (c.s.). An arbitrary c.v. and the fiber element within this c.v. are identified by the subscript "i". The upper and lower control surfaces of this c.v. are identified by the subscripts "l" and "l+Δl", respectively. At any time t, the fiber element i has coordinates $(X_i,Y_i)$ and velocity $\bar{v}_{f,i}=(v_{f,x,i},v_{f,y,i})$. FIG. 26 shows an arbitrary fiber element within a control volume.

These additional assumptions were made to facilitate the solution to the model:

(1) The fiber does not offer any resistance to bending.

(2) The fluid forces on each element of the fiber may be assumed to be the same as those acting on an element of a long, straight cylinder of the same diameter and inclination.

(3) The fiber tension is dependent only on the polymer velocity gradient along the fiber axis. The fiber axis is directed in the z direction; see FIG. 27. Of course, the direction of z is dependent both on time and spatial position.

(4) Only two-dimensional (x-y) motions are considered.

Continuity Equation

In difference form the continuity equation for an element i can be written as $$-(\rho_f v_{f,y} A)|_{i,l} + (\rho_f v_{f,y} A)|_{i,l+\Delta l} + \frac{\Delta m_i}{\Delta t} = 0 \quad (1)$$

where $\rho_f$ is fiber density, A is the fiber cross sectional area at a control surface, $m_i$ is the mass of the element, and t is time.

Momentum Equation

The external forces acting on a fiber element are the gravitational force in the vertically downward direction, the aerodynamic force, and the rheological forces (see FIG. 26). The aerodynamic force vector acting on the element can be resolved into lift ($F_L$) and drag ($F_D$) forces with respect to the stationary (x-y) coordinate system. There is a rheological force at the upper c.s. ($F_{rheo,x,l}$) and a rheological force at the lower c.s. ($F_{rheo,x,l+\Delta l}$). In difference form the x momentum balance for an arbitrary element i is $$(F_L - F_{rheo,xl} + F_{rheo,x,l+\Delta l})|_i = -(v_{f,x}\rho_f v_{f,y} A)|_{i,1} + (v_{f,x}\rho_f v_{f,y} A)|_{i,l+\Delta l} + v_{f,x,i}\frac{\Delta m_i}{\Delta t} + m_i \frac{\Delta v_{f,x,i}}{\Delta t} \quad (2)$$

The y momentum balance is $$(m_i g_y + F_D - F_{rheo,y,l} + F_{rheo,y,l+\Delta l})|_i = -(v_{f,y}^2 \rho_f A)|_{i,1} + (v_{f,y}^2 \rho_f A)|_{i,l+\Delta l} + v_{f,y,i}\frac{\Delta m_i}{\Delta t} + m_i \frac{\Delta v_{f,y,i}}{\Delta t} \quad (3)$$

Energy Equation

In difference form the energy balance for the fiber element is $$-(\rho_f c_{p,f}[(T_f v_{f,y} A)|_l - (T_f v_{f,y} A)|_{l+\Delta l}])|_i + \left[ c_{p,f}\left( T_f \frac{\Delta m}{\Delta t} + m\frac{\Delta T_f}{\Delta t} \right) \right]|_i = -\left[ h\pi \frac{(d_l + d_{l+\Delta l})}{2} \frac{\Delta l}{\cos(\alpha)} (T_f - T_a) \right]|_i \quad (4)$$

where $c_{p,f}$ is the fiber heat capacity, $T_f$ is fiber temperature, $T_a$ is the air temperature, and h is the convective heat transfer coefficient.

The Set of O.D.E.'s (Ordinary Differential Equations)

In the limit as $\Delta t \to 0$, equations 1–4 can be rearranged to give $$\frac{dm_i}{dt} = -[(\rho_f v_{f,y} A)|_{l+\Delta l} - (\rho_f v_{f,y} A)|_l]|_i \quad (5)$$

$$\frac{dv_{f,x,i}}{dt} = \left( -v_{f,x,i}\frac{dm_i}{dt} - [(\rho_f v_{f,y} A v_{f,x})|_{l+\Delta l} - (\rho_f v_{f,y} A v_{f,x})|_l]|_i + (F_L - F_{rheo,x,l} + F_{rheo,x,l+\Delta l})|_i \right) / m_i \quad (6)$$

An additional differential equation is provided from the relation $$\frac{dv_{f,y,i}}{dt} = \left( -v_{f,y,i}\frac{dm_i}{dt} - [(\rho_f v_{f,y} A v_{f,y})|_{l+\Delta l} - (\rho_f v_{f,y} A v_{f,y})|_l]|_i + (m g_y + F_D - F_{rheo,y,l} + F_{rheo,y,l+\Delta l})|_i \right) / m_i \quad (7)$$

-continued $$\frac{dT_{f,i}}{dt} = \left( -c_{p,f,i} T_{f,i}\frac{dm_i}{dt} - [(\rho_f v_{f,y} A c_{p,f} T_f)|_{l+\Delta l} - (\rho_f v_{f,y} A c_{p,f} T_f)|_l]|_i - \left[ h\pi \frac{d_l + d_{l+\Delta l}}{2} dz(T_f - T_a) \right]|_i \right) / (m_i c_{p,f,i}) \quad (8)$$

$$\frac{dx_{f,i}}{dt} = v_{f,xi} \quad (9)$$

Equations 5–9 are algebraic in nature in the space (y) domain and differential in nature in the time (t) domain. Consequently, the solution techniques for ordinary differential equations (O.D.E.'s) can be applied to solve the equations with t as the primary independent variable and y as the secondary independent variable. The dependent variables are the mass ($m_i$), temperature ($T_{f,i}$), transverse velocity in the x direction ($v_{f,x,i}$), velocity in the y direction ($v_{f,y,i}$), and the transverse position ($x_{f,i}$) of the mass in the c.v. Thus, there are five equations in five unknowns. These equations are solved simultaneously for each c.v. Of course, since the fiber elements in each c.v. are all connected as are beads along a string, the solution for a c.v. is dependent on the solution of the equations for the adjacent c.v.'s. One has to therefore progressively solve the equations for all the c.v.'s at a given moment in time. Moreover, initial conditions (I.C.'s) are required for all the dependent variables along the length of the fiber. Also, boundary conditions (B.C.'s) are required at the start and end of the fiber length.

To proceed with the solution of equations 5–9, one also needs expressions for the fiber cross-sectional areas at the control surfaces ($A_l$ and $A_{l+\Delta l}$), the aerodynamic force components ($F_L$ and $F_D$), the rheological force components ($F_{rheo,x,l}$, $F_{rheo,x,l+\Delta l}$, $F_{rheo,y,l}$, and $F_{rheo,y,l+\Delta l}$), and the convective heat transfer coefficient (h). A discussion of how these variables are expressed will now be given.

Fiber Cross-sectional Areas at the Control Surfaces

Because of the ellipsoidal shape of the fiber cross sections at the upper and lower c.s.'s, the appropriate relations for $A_{i,l}$ and $A_{i,l+\Delta l}$ are $$A_{i,l} = \pi\left( \frac{d_{i,l}^2}{4\cos(\alpha_{i,l})} \right) \quad (10)$$

and $$A_{i,l+\Delta l} = \pi\left( \frac{d_{i,l+\Delta l}^2}{4\cos(\alpha_{i,l+\Delta l})} \right) \quad (11)$$

where $$\alpha_{i,l} = \tan^{-1}\left( \frac{x_{f,i} - x_{f,i-1}}{\Delta l} \right) \quad (12)$$

$$\alpha_{i,l+\Delta l} = \tan^{-1}\left( \frac{x_{f,i+1} - x_{f,i}}{\Delta l} \right) \quad (13)$$

$$-90° \leqq \alpha_{i,1} \leqq 90° \quad (14)$$

$$-90° \leqq \alpha_{i,1+\Delta 1} \leqq 90° \quad (15)$$

The $\alpha_{i,l}$ is the angle at the upper c.s. between the fiber axis (the z direction) and the y axis; the $\alpha_{i,l+\Delta l}$ is similarly defined for the lower c.s. (The $\alpha_i$ is the average of these two angles; see FIG. 27.) Fiber diameter is not a variable in equations 5–9. However, fiber diameter is an important result to know. Further, we need knowledge of fiber diameter for use in equations 10 and 11 (and in our aerodynamic force calculation). To determine fiber diameter, we can approximate a fiber element as the frustum of a cone. The mass $m_i$ of the polymer in the element can then be defined as $$m_i = \rho_f \pi \frac{\Delta l}{12\cos(\alpha_i)} (d_{i,l}^2 + d_{i,l}d_{i,l+\Delta l} + d_{i,l+\Delta l}^2) \quad (16)$$

To calculate the threadline diameter profile at a particular time t, Equation 16 is used by first starting at the top element of the threadline where $d_l$ is known. The bottom diameter $d_{l+\Delta l}$ can then be determined, since $m_1$ is known. The procedure is repeated for each successive element until the entire diameter profile has been determined.

The Aerodynamic Force

As a result of the transverse (x direction) motions of the fiber, the fiber elements may assume varying orientations with respect to the y axis. Matsui, M. ("Air Drag on a Continuous Filament in Melt Spinning", *Trans. Soc. Rheol.*, 1976, 20(3), 465–473) and Majumdar and Shambaugh (1991) developed empirical correlations for the friction coefficient in parallel flow at the air-filament interface. Ju, Y. D. and Shambaugh, R. L., "Air Drag on Fine Filaments at Oblique and Normal Angles to the Air Stream, accepted for publication in *Polym. Eng. Sci.*, 1993, showed how the total force on a filament at an oblique angle to the flow can be correlated by separating the force into parallel and normal components. They developed a correlation for the normal drag force which can be combined with Majumdar and Shambaugh's correlation to evaluate the total force on an oblique filament.

For a melt blowing system with transverse fiber motions, the appropriate definition for the parallel drag force is $$F_{PAR} = C_f \frac{1}{2} \rho_a (v_{a,eff,PAR})^2 (\pi d_f L_f) \quad (17)$$

The $L_f$ is the length of the fiber element. The $C_f$ is the skin coefficient which is defined by a modified form of the Matsui (1976) relation as $C_f = \beta(Re_{DP})^{-n}$. The appropriate definition of $Re_{DP}$ for our system is $Re_{DP} = \rho v_{a,eff,PAR} d_f / \mu_a$. Majumdar and Shambaugh determined that B=0.78 and n=0.61 are appropriate values for melt blowing conditions.

The definition of the normal (cross flow) force is $$F_N = C_{DN} \frac{1}{2} \rho_a (v_{a,eff,N})^2 (d_f L_f) \quad (18)$$

The $C_{DN}$ is the drag coefficient which was correlated by Ju and Shambaugh (1993) as $C_{DN} = 6.958 * Re_{DN}^{-0.4399} (d_f/d_o)^{0.4044}$. The Reynolds number ($Re_{DN}$) is based on the normal component of the air; for our system, the appropriate definition for $Re_{DN}$ is $Re_{DN} = \rho_a V_{a,eff,N} d_f / \mu_a$.

The aerodynamic force correlations and Reynolds numbers just given employ the parallel and normal components of the effective velocity of air with respect to the fiber. In the case of a stationary filament the effective air velocity ($\bar{v}_{a,eff}$) is the same as the actual air velocity ($\bar{v}_a$). However, a melt blown fiber exhibits both axial and transverse motion. As a result, the effective air velocity as seen by the fiber is different than the actual air velocity.

Figure 27:
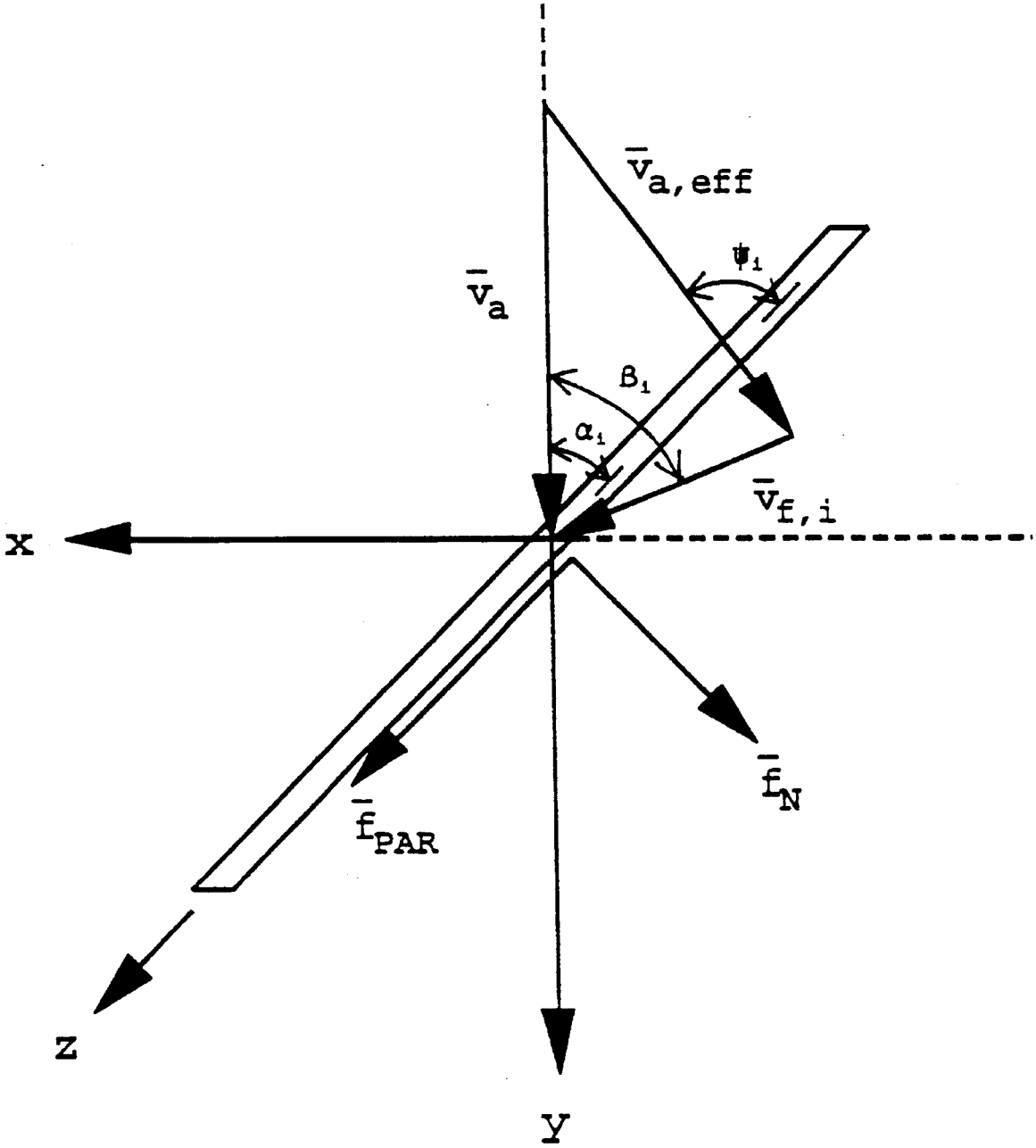
FIG. 27 is a diagram of the axis of a fiber.

Consider a fiber element as shown in FIG. 27. The fiber element is inclined at an angle $\alpha_i$ relative to the vertical (the y-axis). The element has a velocity $\bar{v}_{f,i}$ at an angle $\beta_i$ relative to the vertical. The angles $\alpha_i$ and $\beta_i$ can vary from −90° to +90°. Inclinations measured clockwise from the vertical are positive and vice-versa. The unit vector $\bar{f}_{PAR}$ along the fiber (z) axis and the unit normal vector $\bar{f}_N$ directed outward from the fiber surface are, respectively, given by $$\overline{f_{PAR}} = \sin(\alpha_i)\mathfrak{I} + \cos(\alpha_i)\mathfrak{J} \quad (19)$$

$$\bar{f}_n = \cos(\alpha_i)\mathfrak{I} + \sin(\alpha_i)\mathfrak{J} \quad (20)$$

where $\bar{i}$ and $\bar{j}$ are unit vectors in the x-y coordinate system. The air and polymer velocity vectors may be written in component form as $$\bar{v}_a = v_{a,x}\mathfrak{I} + v_{a,y}\mathfrak{J} \quad (21)$$

$$\overline{v_{f,i}} = v_{f,x,i}\mathfrak{I} + v_{f,y,i}\mathfrak{J} \quad (22)$$

$$\overline{v_{a,eff}} = (v_{a,x} - v_{f,y,i})\mathfrak{I} \quad (23)$$

The normal ($\bar{v}_{a,eff,N}$) and parallel ($\bar{v}_{a,eff,PAR}$) components of the effective air velocity with respect to the fiber (z) axis are given by $$\overline{v_{a,eff,N}} = (\overline{v_{a,eff}} \cdot \overline{f_N})\ \overline{f_N} \quad (25)$$

$$\overline{v_{a,eff,PAR}} = (\overline{v_{a,eff}} \cdot \overline{f_{PAR}} \quad (25)$$

The magnitude of the velocities from equations 24 and 25 can be used in equations 17 and 18 to calculate the magnitude of the parallel ($F_{PAR}$) and normal ($F_N$) components of the aerodynamic force, respectively. The directions of these force components are described by the unit vectors $\bar{f}_{PAR}$ and $\bar{f}_N$, respectively. Since the quantities calculated from equations 17 and 18 are always positive, the signs of $F_{PAR}$ and $F_N$ must be determined from the signs of the relative velocity components. Specifically, $$\begin{aligned} \overline{F_{PAR}} &= F_{PAR}\overline{f_{PAR}} \quad (26) \\ &= F_{PAR}(\sin(\alpha_i)\bar{i} + \cos(\alpha_i)\bar{j}) \qquad \text{for } v_{a,eff,PAR} > 0 \\ \overline{F_{PAR}} &= F_{PAR}\overline{f_{PAR}} \quad (27) \\ &= F_{PAR}(-\sin(\alpha_i)\bar{i} - \cos(\alpha_i)\bar{j}) \qquad \text{for } v_{a,eff,PAR} < 0 \\ \overline{F_N} &= F_N\overline{f_N} \quad (28) \\ &= F_N(\cos(\alpha_i)\bar{i} - \sin(\alpha_i)\bar{j}) \qquad \text{for } v_{a,eff,N} > 0 \\ \overline{F_N} &= F_N\overline{f_N} \quad (29) \\ &= F_N(-\cos(\alpha_i)\bar{i} + \sin(\alpha_i)\bar{j}) \qquad \text{for } v_{a,eff,N} < 0 \end{aligned}$$

The total vector aerodynamic force $\bar{F}_T$ is then $$\overline{F_T} = \overline{F_{PAR}} + \overline{F_N} \quad (30)$$

Heat Transfer Correlation

When air flow is perpendicular to a fiber (i.e., there is crossflow), the Nusselt number can be determined from the following correlation (Andrews, E. H., "Cooling of a Spinning Threadline", *Brit. J. Appl. Phys.*, 1959 10(1), 39–43; Kase, S. and Matsuo, T., "Studies on Melt Spinning. I. Fundamental Equations on the Dynamics of Melt Spinning"*J. Polym. Sci.*, 1965, Part A, 3, 2541–2554):

$$NU_{\psi=90°} = 0.764 Re_{eff}^{0.38} \quad (31)$$

where $$Re_{eff} = \frac{\rho_a v_{a,eff} d_{f,i}}{\mu_a} \quad (32)$$

$$\psi_i = \tan^{-1}\left(\frac{|v_{a,eff,N}|}{|v_{a,eff,PAR}|}\right) \quad (33)$$

In equations 32 and 33 the Reynolds number and the angle ψ between the fiber axis and the effective air velocity have been defined for the melt blowing system (see FIG. 3). The Nusselt number is defined as $Nu = hd_f/k_a$, where h is the convective heat transfer coefficient and $k_a$ is the thermal conductivity of the air.

Generally, ψ≠90° for melt blowing—i.e., the fiber is oblique to the (effective) air flow. Morgan, V. T. ("Advances in Heat Transfer", Academic Press: New York, N.Y., 1975, Vol 11, pp 239–243) gives a comprehensive summary of research on heat transfer from fine cylinders oblique to the air stream. With a least squares fit of the experimental data from Mueller, A. C. ("Heat Transfer from Wires to Air in Parallel Flow", *Trans. Amer. Inst. Chem. Eng.*, 1942, 38, 613–627) and Champagne et al. ("Turbulence Measurements with Inclined Hot-Wires. Part 1. Heat Transfer Experiments with Inclined Hot-Wire" *J. Fluid Mech.*, 1967, 28 (1), 153–175), the following relation can be written to predict the Nusselt number for flow oblique to a fiber:

$$\frac{Nu_{\psi}}{Nu_{\psi=90^\circ}} = 0.590 \sin^{0.849}(\psi) + 0.400 \tag{34}$$

Equation 34, combined with equation 31, can be used to calculate h in our melt blowing system.

The Rheological Forces

As described by Uyttendaele and Shambaugh (1990), the axial rheological stress is $$F_{rheo} = \frac{\pi d_f^2}{4}(\tau^{zz} - \tau^{x'x'}) \tag{35}$$

For a Newtonian fluid, Middleman, S. ("Fundamentals of Polymer Processing", McGraw-Hill Book Company, New York, N.Y., 1977) defines the $\tau^{zz}$ and $\tau^{x'x'}$ as $$\tau^{zz} = 2\eta_f \frac{dv_{f,z}}{dz} \tag{36}$$

$$\tau^{x'x'} = -\eta_f \frac{dv_{f,z}}{dz} \tag{37}$$

where the z direction is as shown in FIG. 3 and x' is the direction perpendicular to the z direction. For the geometry of our problem (see FIG. 27), the device of defining the z direction maintains the simple form of the constitutive equations. Furthermore, complex (e.g., viscoelastic) constitutive equations may be used in place of equations 36 and 37.

(Melt blowing involves rapid temperature changes. Hence, as found by Uyttendaele and Shambaugh (1990), a Newtonian model often predicts behavior almost as well as a viscoelastic model.)

From the problem geometry and from equations 35–37, the x and y components of the axial rheological stress can be written as $$F_{rheo,x,i,l} = \pi\left(\frac{d_f^2}{4}\, 3\eta_f \frac{dv_{f,z}}{dz} \sin(\alpha)\right)\Big|_{i,l} \tag{38}$$

$$F_{rheo,y,i,l} = \pi\left(\frac{d_f^2}{4}\, 3\eta_f \frac{dv_{f,z}}{dz} \cos(\alpha)\right)\Big|_{i,l} \tag{39}$$

The above equations are written for the control surface l at the top of the control volume. Similar equations can be written for the bottom surface.

At the upper control surface the gradient of the velocity along the fiber axis can be approximated as $$\left(\frac{dv_{f,z,}}{dz}\right)\Big|_{i,l} = \frac{v_{f,z,i} - v_{f,z,i-1}}{\Delta l}\cos(\alpha_{i,l}) \tag{40}$$

A similar relation applies at the lower control surface. The velocity along the fiber axis can be calculated from the velocity of the element in the x-y coordinate system. For element i this relation is simply $$v_{f,z,i} = (\overline{v_{f,i} \cdot \hat{t}_{PAR}}) \tag{41}$$

Velocity and Temperature Correlations

In order to solve our model equations 5–9, the air velocity and temperature need to be known at any position below the melt blowing die. Majumdar (1990) and Majumdar and Shambaugh (1991) have developed dimensionless correlations for an annular die geometry similar to that used in the present experiments. From their work we used the following correlations for the velocity profiles:

$$\frac{v_{jo}}{v_o} = 0.077\, Y(d_{AN}) + 1.000 \text{ for } Y(d_{AN}) < 3.093 \tag{42}$$

$$\frac{v_{jo}}{v_o} = 0.249\, Y(d_{AN}) + 0.468 \text{ for } Y(d_{AN}) \geqq 3.093 \tag{43}$$

$$\frac{v}{v_o} = \exp(-0.693\,(|x|/x_{1/2})^2) \tag{44}$$

$$\frac{x_{1/2}}{d_{AN}} = 0.112\frac{y}{d_{AN}} + 0.040 \text{ for } \frac{y}{d_{AN}} > 4 \tag{45}$$

See the Nomenclature section for definitions of the symbols.

Similarly, for the temperature profiles we used the following correlations:

$$\frac{\theta_{jo}}{\theta_o} = 0.033\, Y(d_{AN}) + 1.000 \text{ for } Y(d_{AN}) < 4.644 \tag{46}$$

$$\frac{\theta_{jo}}{\theta_o} = 0.221\, Y(d_{AN}) + 0.127 \text{ for } Y(d_{AN}) \geqq 4.644 \tag{47}$$

$$\frac{\theta}{\theta_o} = \exp(-0.693\,(|x|/t_{1/2})^2) \tag{48}$$

$$\frac{t_{1/2}}{d_{AN}} = 0.109\frac{y}{d_{AN}} + 0.155 \text{ for } \frac{y}{d_{AN}} > 4 \tag{49}$$

Again, see the Nomenclature section for definitions of the symbols. (Note: for modeling pulsating flows such as those described above, Equations 42–49 could be modified to account for time dependent velocity and temperature variations, for example, by incorporating a sinusoidal variation in velocity.)

Boundary Conditions

The upper boundary conditions for the model are similar to those used by Uyttendaele and Shambaugh (1990). The fiber velocity and temperature are known at the die and are used as boundary conditions at the start of the threadline. The rheological force ($F_{rheo}$) at the die is guessed, and an iterative procedure determines the correct value for this force. However, unlike the situation in Uyttendaele and Shambaugh's work, the $F_{rheo}$ is time dependent and must be determined as a function of time.

In the lower section of the threadline, Uyttendaele and Shambaugh assumed that the threadline had a "freeze point" where fiber attenuation ceased. The rheological force at the freeze point was balanced by the gravity and air drag forces acting on the frozen segment of the filament. Of course, in the Uyttendaele and Shambaugh model the frozen segment is stationary (no vibration occurs) and oriented vertically.

If the frozen filament boundary condition is applied to our general model which includes fiber vibration, it can no longer be assumed that the frozen segment does not vibrate. Inertial forces are associated with this vibration, and these forces will be transmitted to the main (unfrozen) threadline. Furthermore, the air drag on the frozen filament cannot be calculated unless the configuration of the frozen filament is known. In addition, the mass of the frozen filament will vary as a function of both the filament diameter and the variable length of the frozen filament (the length between the freeze point and the collection screen depends on the frozen filament configuration). Because of all these difficulties, the freeze point assumption was modified and called a "stop point" assumption.

Iteration over the threadline is stopped at the stop point. The stop point is defined as the point where the air velocity and the fiber velocity become equal. Beyond the stop point, the air is actually pushing the fiber upwards. Since it is difficult to transmit a compression force along a thin fiber, the fiber tends to buckle at positions beyond the stop point and the fiber floats down to the collection screen. It is assumed that the fiber segment beyond the stop point does not transmit any forces to the fiber segment above the stop point—i.e., it is assumed that $F_{rheo}$ is zero at the stop point.

Figure 28:
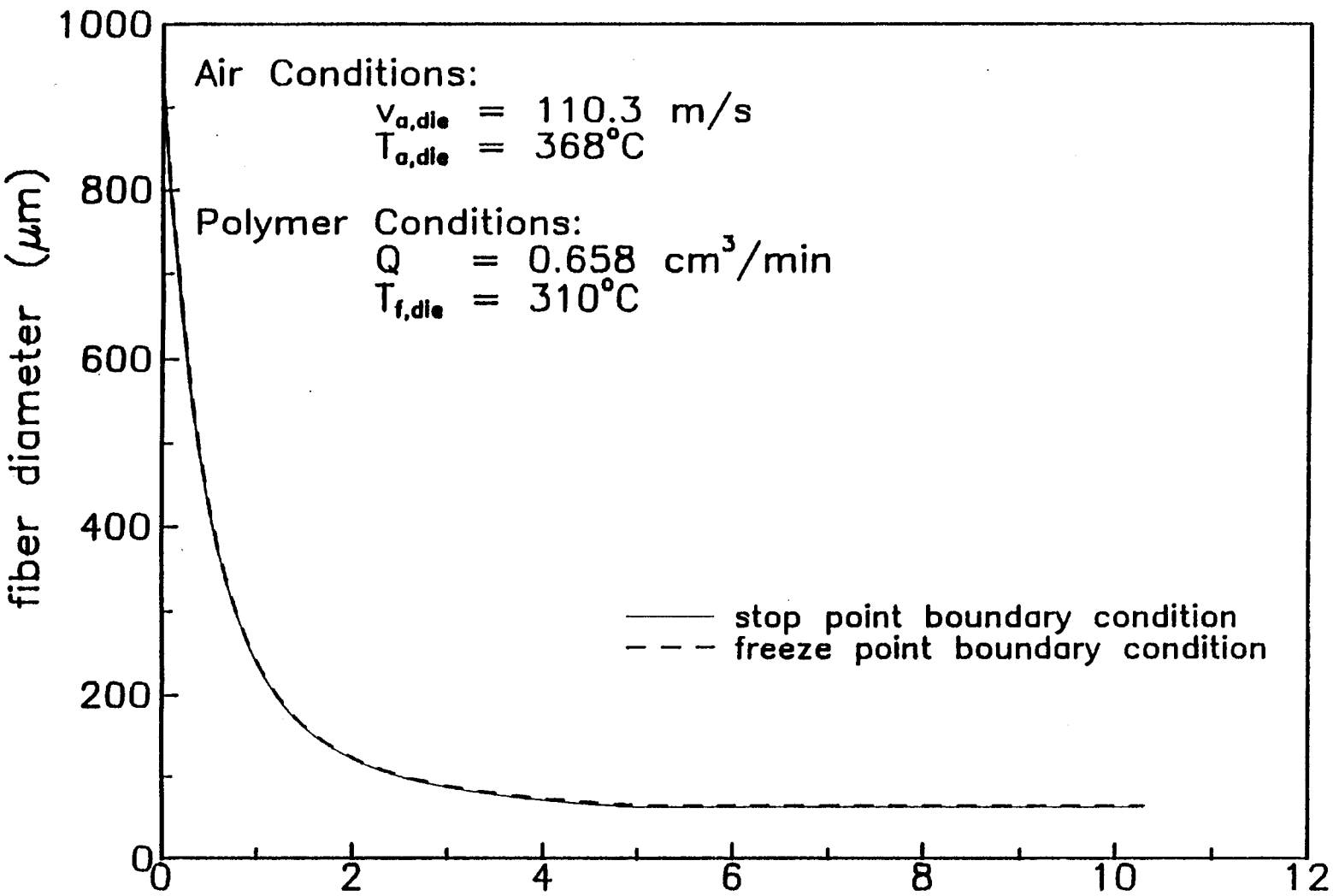
FIG. 28 is a graph showing predicted fiber diameter at points along the fiber stream at a 110 m/s air velocity.

FIG. 28 shows Uyttendaele and Shambaugh's prediction of fiber diameter profile for melt blowing with 110 m/s air velocity. Their prediction was based on an assumed freeze point of y=5 cm. Also on FIG. 28 is a predicted profile based on the stop point boundary condition. The stop point occurs at y=10.3 cm. As can be seen, the predictions are virtually identical. Hence, a stop point boundary condition is probably as accurate as the freeze point boundary condition. The stop point criterion was used for our model calculations.

The initial conditions assumed for fiber diameter, fiber velocity, etc. used in our model calculations are discussed below in the Model Results section. A first guess for the location of the stop point (velocity crossover point) was estimated by using the Uyttendaele and Shambaugh model with a freeze point assumption.

EXPERIMENTAL DETAILS

A single hole melt blowing die was used in our studies. The spinneret capillary was 0.5334 mm (0.021 in) inside diameter with an L/D of 30. The gas annulus was concentric with the spinneret capillary. The annulus had a 1.656 mm (0.0652 in) outside diameter and a 0.8256 mm (0.0325 in) inside diameter. The polymer used was 75 MFR 3860X Fina polypropylene. The ambient temperature was 23±1° C. Further details on the melt blowing equipment used in our studies are given by Kayser and Shambaugh (1990).

Measurements of fiber vibrations were done with high speed strobe photography. The camera used was a Canon AE-1 equipped with a Tokina AT-X Macro 90 mm lens. An exposure time of ¼ second was used. Illumination was provided by a digital strobe set at a frequency of 100 flashes per second. Hence, each photograph contained 25 exposures.

MODEL RESULTS

Comparison with Uyttendaele and Shambaugh's Results

Figure 29:
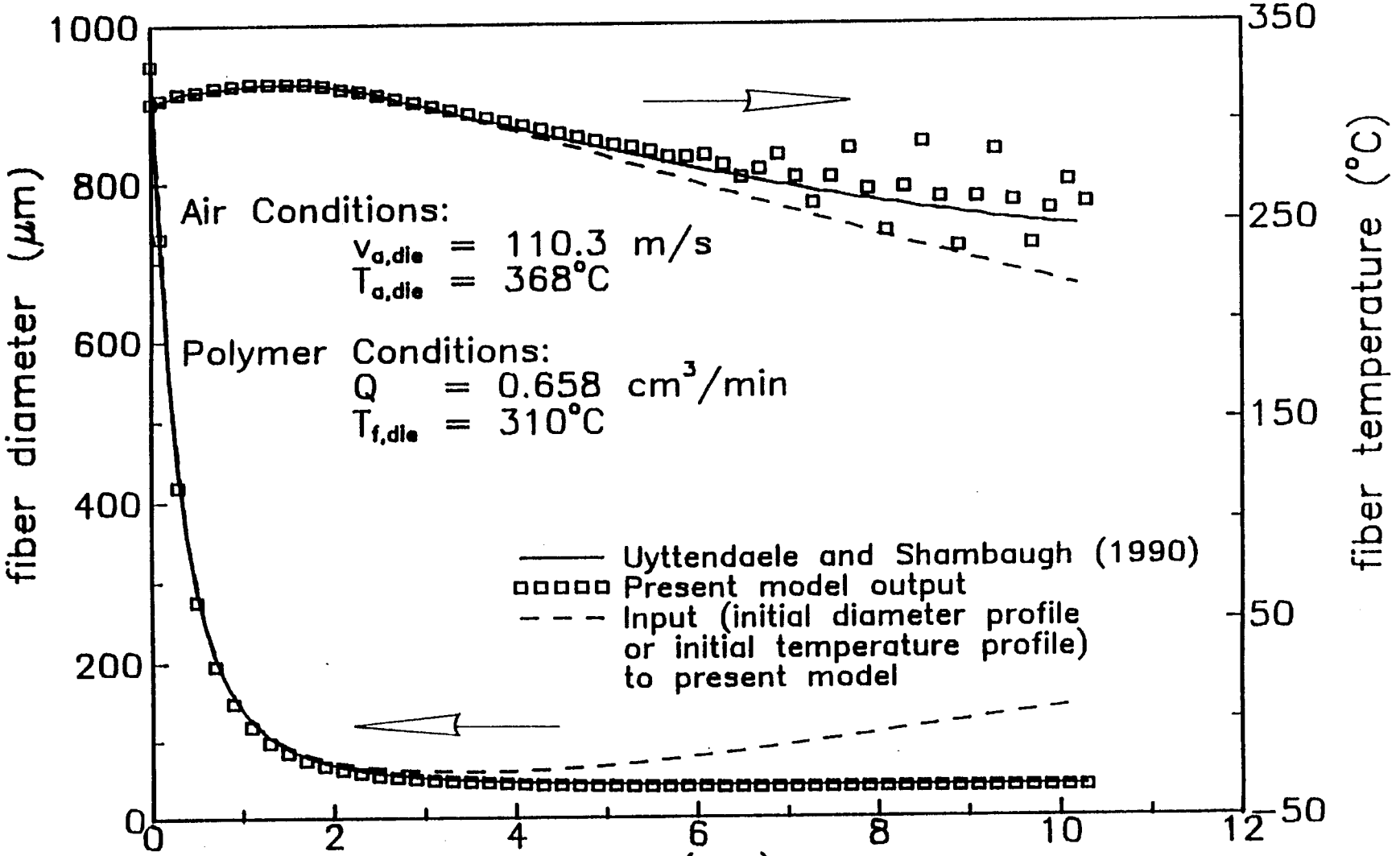
FIG. 29 is a graph comparing fiber diameter and fiber temperature predictions of the present model and the Uyttendaele and Shambaugh model.

Equations 5–9 were solved numerically on an IBM RISC System/6000. Initial conditions for each fiber element included (a) position, (b) velocity, (c) diameter, and (d) temperature. It was found that the model predicts no fiber vibration if the initial transverse (x direction) displacement and transverse velocity are zero for each element. FIG. 29 shows diameter profile predictions from the model for this particular case. Also shown on FIG. 29 is the input diameter profile. Within reason, the model predicts the same diameter profile no matter what initial profile is selected. The polymer type, capillary diameter, gas velocity, and all other experimental conditions used as inputs to the model were the same as those used by Uyttendaele and Shambaugh (1990). Their results are also shown on FIG. 29. As can be seen, the new model matches their results extremely well. This match is evidence of the accuracy of the new model, since, with no vibration, the new model should mimic the results of Uyttendaele and Shambaugh. Further, since the predictions of Uyttendaele and Shambaugh match experimental data quite well, so do the predictions of our new model.

FIG. 29 also compares the temperature profile prediction of our model with the prediction of Uyttendaele and Shambaugh's model. The predictions are essentially identical up to about y=5 cm. Beyond 5 cm the new model begins to exhibit a "chatter" in the fiber temperature. However, these chatter values bound the Uyttendaele and Shambaugh prediction, and, when averaged, produce a prediction that closely matches the Uyttendaele and 'Shambaugh prediction. Some of the chatter values vary by as much as 20° C. from values at adjacent y positions. (Keep in mind that the element size (control volume height) was 2 mm for the model calculation.) It is physically unlikely that gradients of this size could occur—particularly since, at large distances from the die head, physical changes in the fiber become more gradual. The predicted temperature values in FIG. 29 (as well as the diameter values) are values at a particular time—t=5 seconds. The chatter values change if values at, e.g., t=4 seconds are used for the temperature profile. However, the average profile (averaged from t=2 to t=5 seconds) of the chatter values remains constant.

Figure 30:
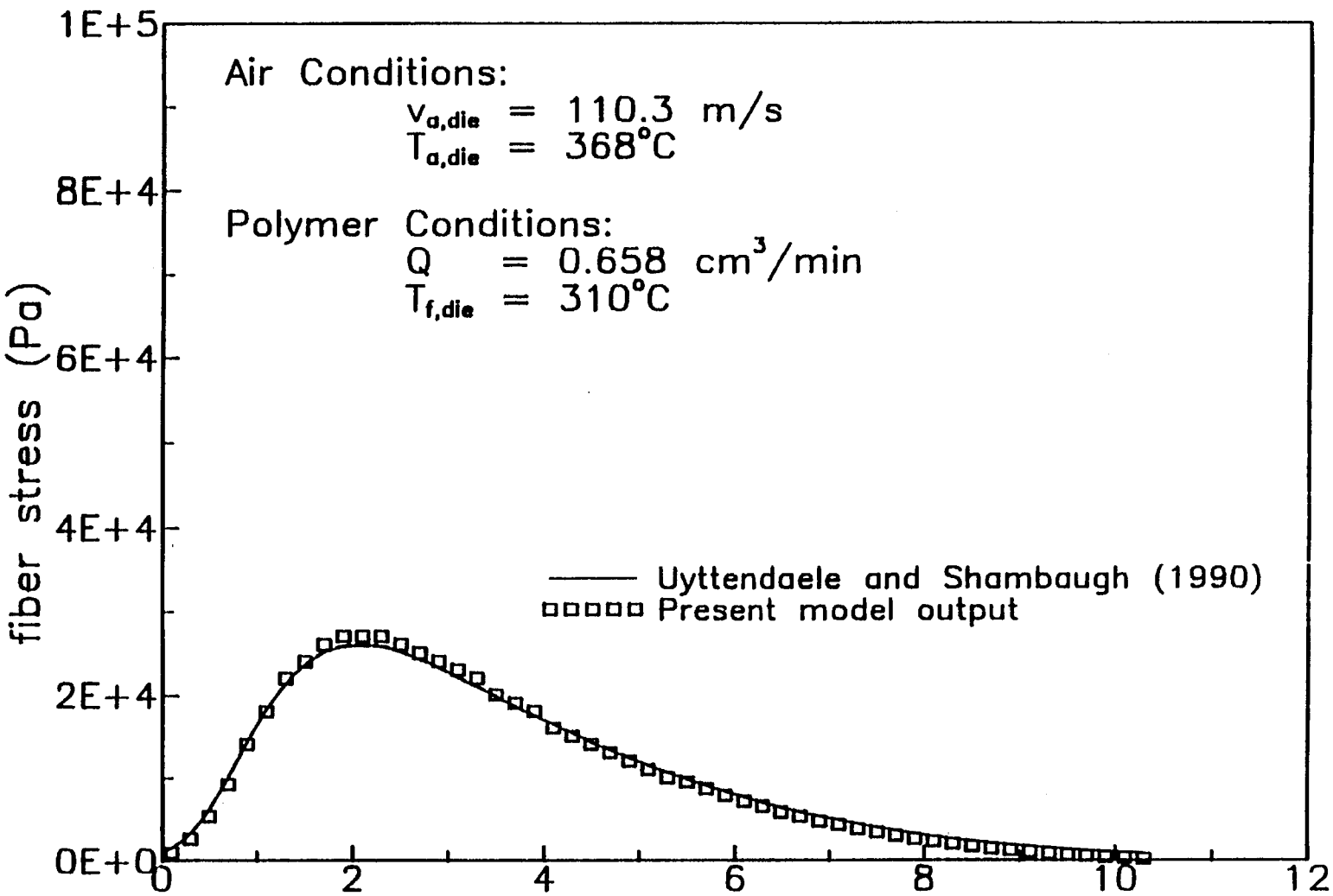
FIG. 30 is a graph showing comparing predicted fiber stress values of the present model with the U-S model.

FIG. 30 compares the stress growth prediction of our model with the stress growth prediction of Uyttendaele and Shambaugh's model. The results are very close. As with the diameter and temperature values in FIG. 29, the stress values on FIG. 30 are values at a particular time—t=5 seconds.

The Effect of Fiber Vibration

By including transverse displacement and/or transverse velocity as initial conditions for the elements, the effect of fiber vibration can be examined. Fiber vibrations were induced in our model by assuming a linear initial x displacement of the fiber with a slope of $\Delta x/\Delta y=10^{-5}$ and a zero displacement at y=0. The transverse fiber velocity was set at 0 m/sec. Similar to that observed previously in the calculations for FIGS. 28–30, the initial conditions did not affect the final answers. For example, for initial slopes ($\Delta x/\Delta y$) equal to $10^{-5}$, $10^{-4}$, and $10^{-3}$, the final answers were the same. It was found that final answers remained unchanged after 2 seconds of running time; to be conservative, a run time of 5 seconds was used for all of our runs.

Figure 31:
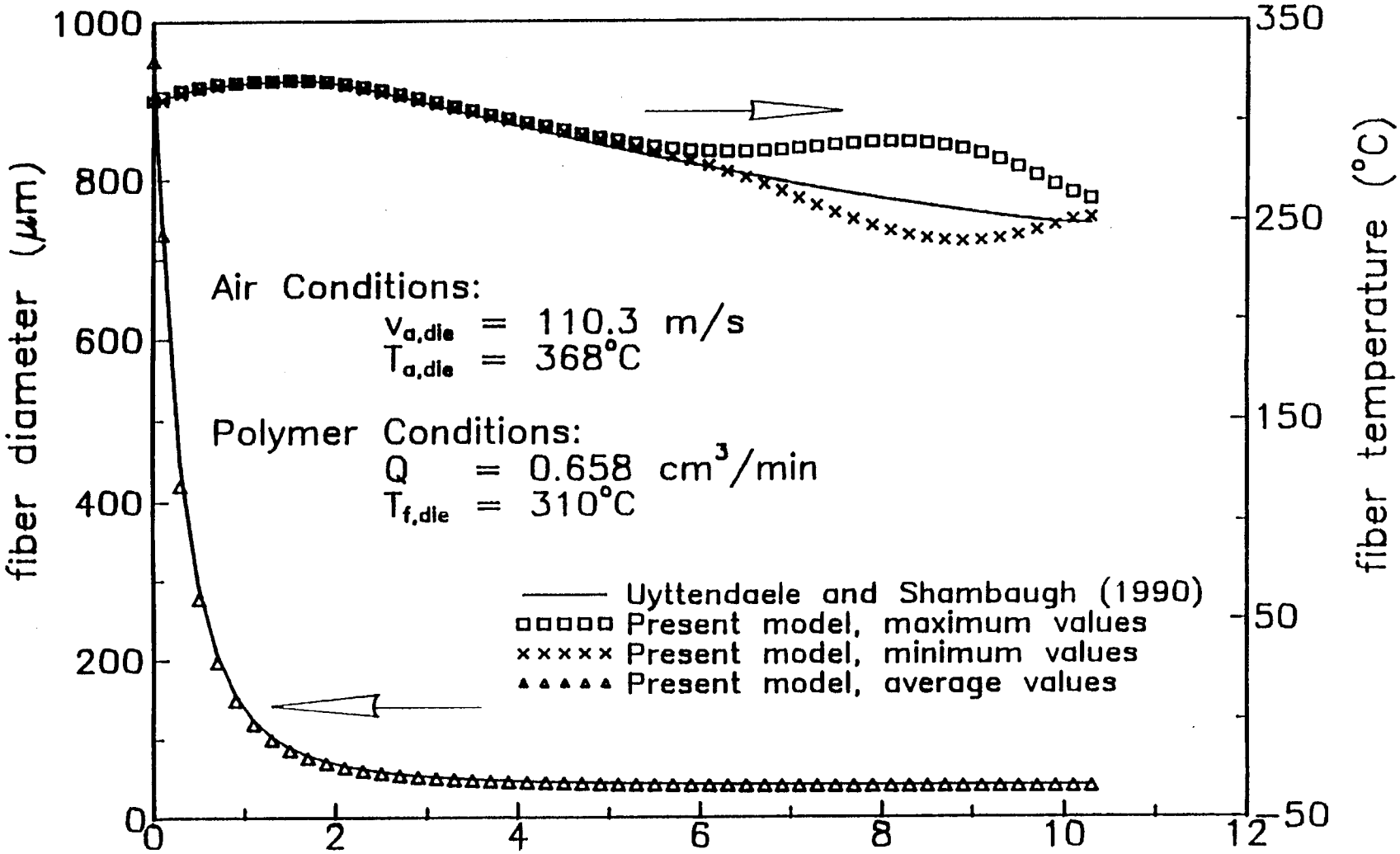
FIG. 31 is a graph showing fiber diameters predicted from the present model and the U-S model.

The fiber diameter, stress, and fiber temperature were predicted for the same conditions as were used for FIGS. 29 and 30. However, this time an initial transverse displacement of the fiber was assumed. Some of the results of these calculations are shown in FIG. 31. For comparison purposes, Uyttendaele and Shambaugh's predictions are included on this figure. As stated above, the predicted points on FIGS. 29 and 30 are "snapshot" values at t=5 sec. In contrast, the predicted diameter points on FIG. 31 are the average values for the period of the simulation from t=2 to t=5 seconds. At any y, the minimum and maximum predicted values of the fiber diameter are not appreciably different from the average value of the fiber diameter. For example, the fiber diameter at y=2 cm has a range of 67.3 μm to 67.4 μm (based on the entire set of $8.6\times10^5$ iterations from t=2 to t=5 seconds). Similarly, the rheological stress at y=2 cm varies only from $2.67\times10^4$ Pa to $2.68\times10^4$ Pa. Hence, only average values of stress need be considered (more about the stress will be discussed below).

FIG. 31 also shows the temperature prediction; both maximum and minimum values are shown. For y<5 cm, there is little difference between the maximum and the minimum: e.g., at y=2 cm the temperature ranges from 318.7° C. to 319.2° C. However, for y>5 cm there is a somewhat larger difference between the maximum and minimum values. However, in line with our previous discussion of the temperature "chatter" in FIG. 29, this difference probably does not have a physical basis. The Uyttendaele and Shambaugh solution is well matched by the average of the maximum and minimum values.

A comparison of FIG. 31 with FIG. 29 indicates that, for the parameter range used, there are little apparent differences in diameter or temperature predictions when fiber vibration is allowed. Similarly, there is little difference in the stress profile prediction if fiber vibration is allowed: for the case where vibration is allowed, the stress profile along the threadline looks almost identical to FIG. 30. Table 3 compares some of the key parameters from these simulations. As one can see, the vibration in the fiber causes slightly higher stress levels and slightly smaller fiber diameters. Though the differences are small, the directions of change are as expected.

Effects of Variations of Parameters

The principle operating variables for melt blowing equipment are the air velocity, air temperature, polymer flowrate, and polymer temperature. Each of these variables was varied separately

TABLE 3

Effect of fiber vibration on the predictions of the present model Input parameters are listed in FIG. 29 (for no vibration) and FIG. 31 (for when vibration is present).

| vibration present? | final fiber diameter (μm) | maximum elongation rate ($s^{-1}$) | maximum stress ($10^5$ Pa) | y location of maximum elongation rate (cm) | y location of maximum stress (cm) |
|---|---|---|---|---|---|
| No | 38.7 | 263 | 0.26 | 1.8 | 2.0 |
| Yes | 37.1 | 270 | 0.27 | 1.9 | 2.1 |

and the effects on the model predictions were examined. The base operating conditions were the same as used for FIGS. 29–31. For these calculations, the fiber was given an initial displacement with a slope ($\Delta x/\Delta y$) of $10^{-5}$. The simulation was carried out for 5 seconds.

Figure 32:
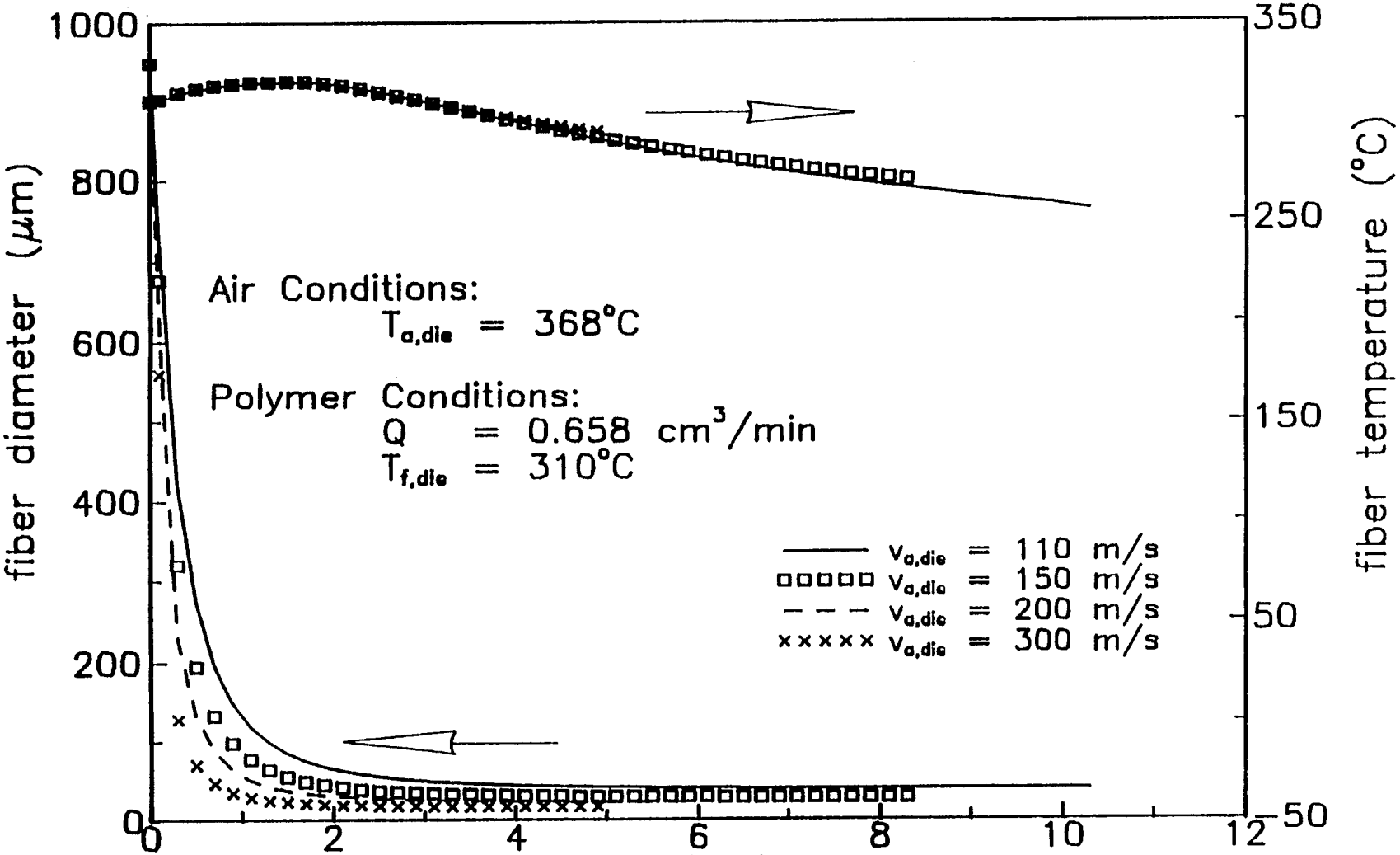
FIG. 32 is a graph showing fiber diameters predicted by the present model under varying air velocities.

FIG. 32 shows the effect of air velocity on fiber diameter. Air velocities of 110, 150, 200, and 300 m/s were considered. As expected, higher air velocities produce much higher attenuation rates. The curves for the higher gas rates end at lower y values because the stop point (where air velocity equals fiber velocity) occurs nearer to the spinneret for a higher air velocity. The values plotted in FIG. 8 are average values for the range t=2 to t=5 seconds.

FIG. 32 also shows the effect of air velocity on fiber temperature. The effect is small for the air velocity range investigated. For example, at y=2 cm the average fiber temperatures are 318.3°, 318.3°, 318.2°, and 318.5° C., respectively, for the 110, 150, 200, and 300 m/s air velocities. As was previously discussed, there is chatter in (instantaneous) fiber temperature predictions for large y. However, the average temperature predictions for t=2 to t=5 seconds are shown in FIG. 32. As described in the discussion of FIG. 29, the average temperature is a good estimate of the actual temperature at a particular instant of time. A second question about averaging concerns whether the temperature of the threadline varies as a function of time. As stated in the discussion of FIG. 31, there is essentially no time variation in the average fiber temperature profile for a 110 m/s gas velocity. For higher gas velocities, the variance of fiber temperature profile—as well as diameter and stress variance—will now be addressed.

The diameter, stress, and temperature (for temperatures at smaller y values) have fairly tight ranges over the time interval t=2 to t=5 seconds. For example, Table 4 shows typical ranges for the fiber parameters for the case of variable air velocity. Though higher gas velocities produce wider variance, the variance is still quite low at the 300 m/s gas velocity. Similar levels of variance occur when air temperature, polymer temperature, and polymer flowrate are the independent variables. Hence, plotting average values of threadline parameters is very representative of the values over the entire time interval (t=2 to t=5 seconds).

Figure 33:
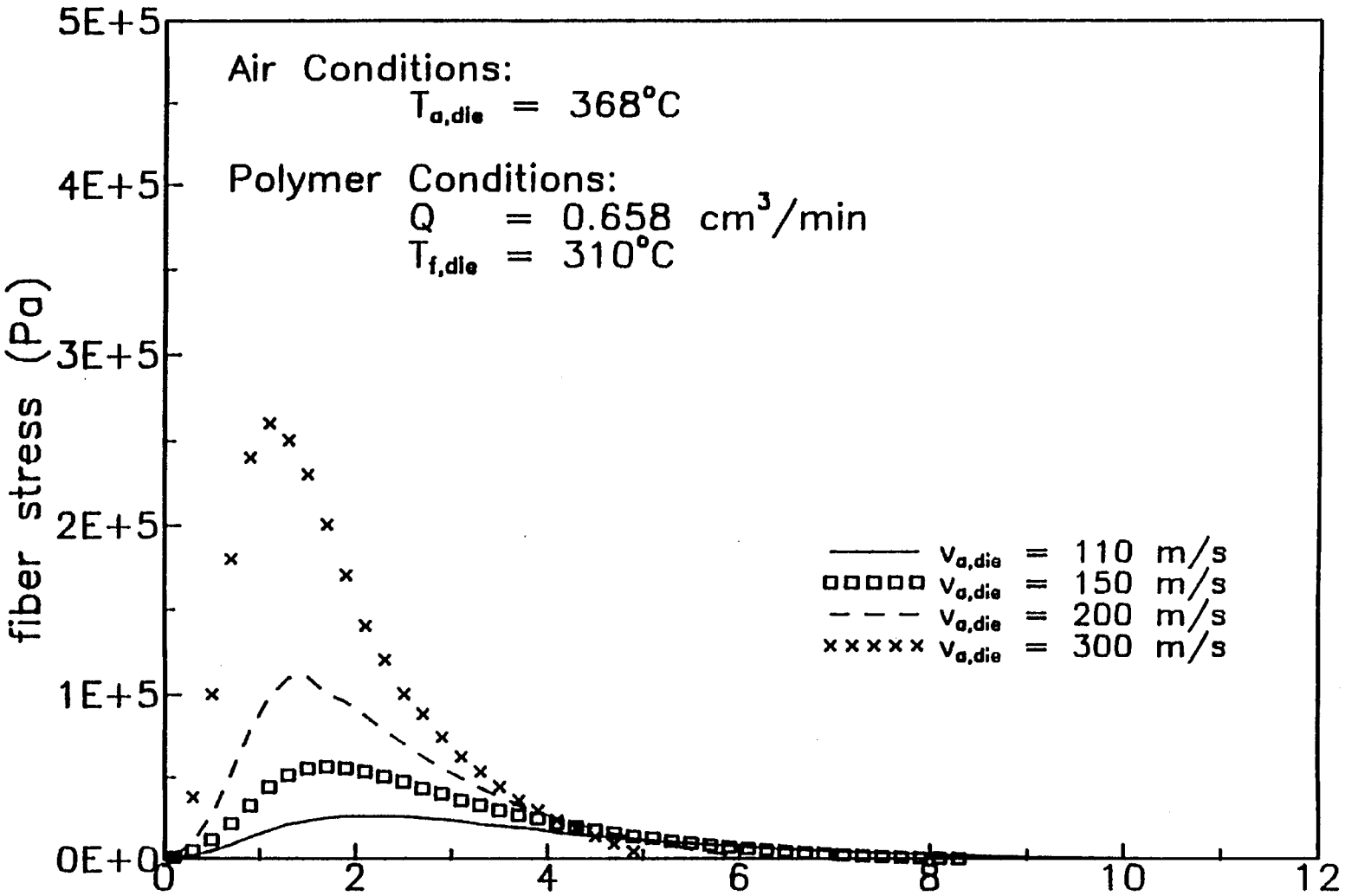
FIG. 33 is a graph showing the effect of air velocity on fiber stress.

FIG. 33 shows the effect of air velocity on rheological stress in the threadline. The peak stress increases significantly with increased gas velocity. Also, the maximum in the stress curve moves closer to the spinneret as air velocity increases.

TABLE 4

The range of fiber parameters when the air velocity is varied. The base conditions are the same as listed in FIG. 32.

| air velocity (m/s) | final fiber diameter (μm) | maximum stress ($10^5$ Pa) | y location of maximum sresss (cm) | peak amplitude (cm) | frequency (Hz) |
|---|---|---|---|---|---|
| 110 | 37.1 | 0.27 | 2.1 | 0.009 | 45 |
| 150 | 29.2–29.3 | 0.56 | 1.7 | 0.028 | 62 |
| 200 | 22.8–23.3 | 1.1 | 1.7 | 0.116 | 20 |
| 300 | 16.3–17.5 | 2.5–2.7 | 1.1 | 0.226 | 8 |

Figure 34:
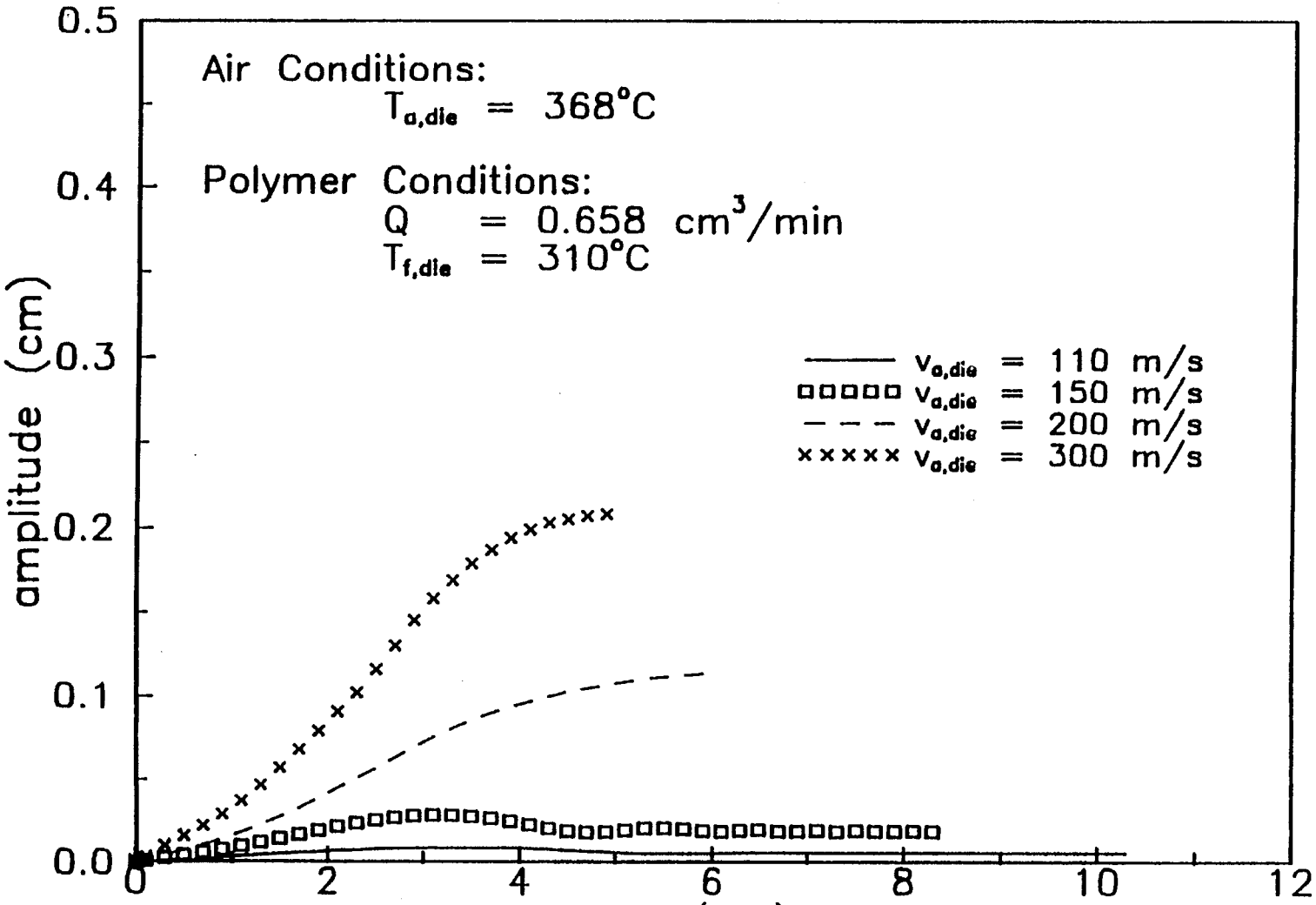
FIG. 34 is a graph showing the effect of air velocity on the amplitude of fiber vibration.

FIG. 34 shows the effect of air velocity on the amplitude of fiber vibration. The amplitude of vibration is defined as the maximum displacement (+x or −x) at a position y that occurs in the range t=2 seconds to t=5 seconds. For a 110 m/s air velocity, the vibration amplitude is very small (about 0.01 cm or less). However, the amplitude increases substantially as air velocity increases: the predicted amplitude values are about 20 times larger for the m/s air velocity.

Figure 35:
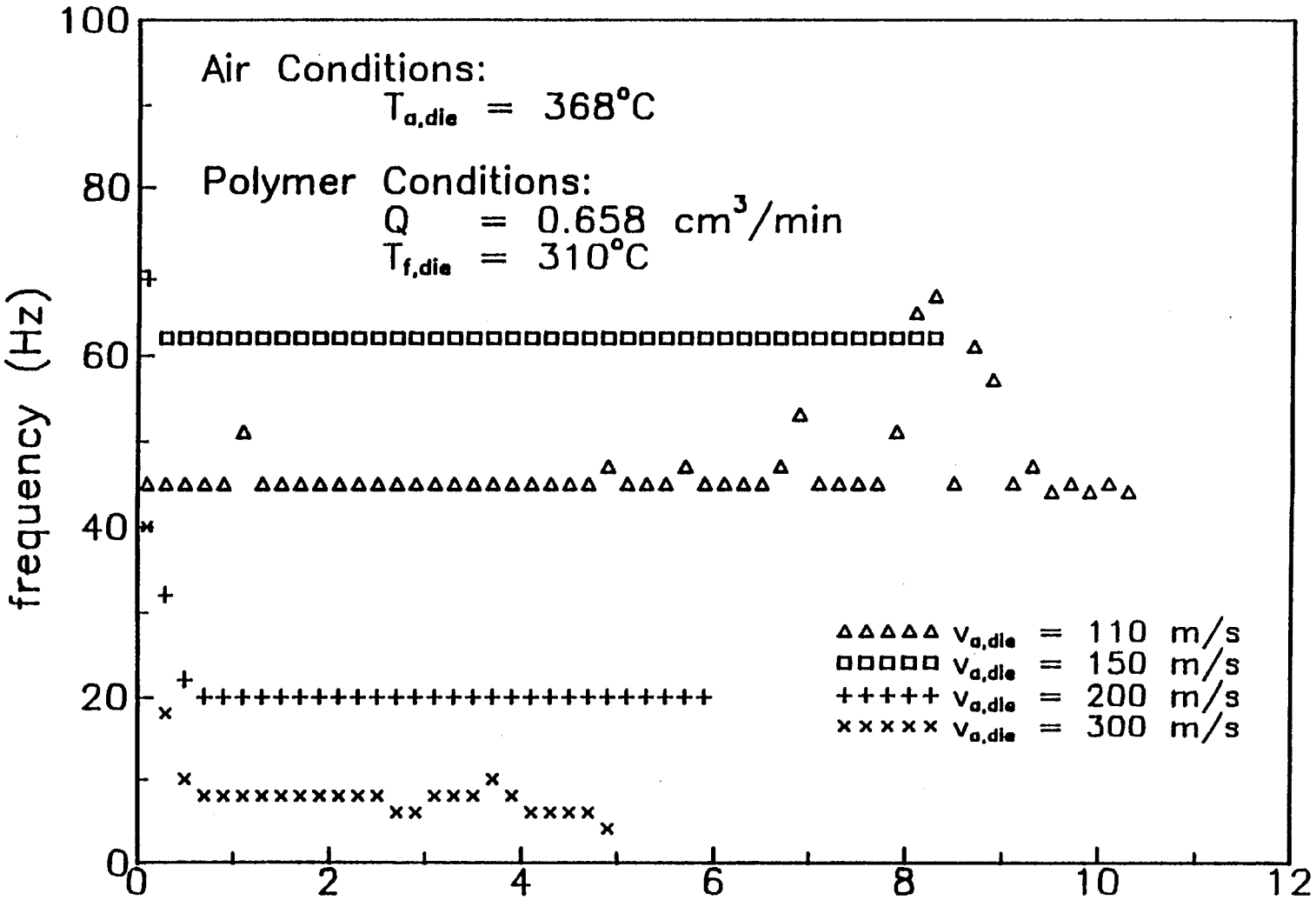
FIG. 35 is a graph showing the effect of air velocity on the frequency of fiber vibration.

FIG. 35 shows the effect of air velocity on the frequency of fiber vibration. The frequency of vibration at a position y is determined by counting the number of times that the fiber element crosses the x=0 line in the time interval from t=2 seconds to t=5 seconds. The frequency of vibration is then this count divided by three seconds and multiplied by one-half (since there are two crossovers of x=0 for each cycle). Observe that the frequency of vibration is nearly constant over the entire threadline—i.e., the entire threadline is vibrating at the same frequency. This is an interesting result when one considers that there are so many variables along the threadline—diameter (mass/length), polymer viscosity, air velocity, etc. For the air velocity range considered, the frequency exhibited a maximum at 150 m/s.

As suggested above, the fiber diameter predictions of FIGS. 31 and 32, the temperature predictions of FIG. 32, the stress predictions of FIG. 33, and the frequency predictions of FIG. 35 are averages determined over a 3 second time interval. The temperature predictions on FIG. 31 are maximum and minimum values for a 3 second interval, and the amplitude predictions on FIG. 34 are maximum values for a 3 second interval. For all these figures (FIGS. 31–35), any 0.5 second interval between t=2 and t=5 seconds produces the same results. Even smaller time intervals will work. For example, the maximum fiber amplitude for the 110 m/s gas velocity (see FIG. 34) remains 0.09 cm if intervals of 0.2 or 0.1 seconds are used. Similarly, the frequency (for the 110 m/s gas velocity) remains 45 Hz for these smaller time intervals. However, when the specified time interval becomes of the order of the time period of oscillation (0.02 seconds for the 110 m/s air velocity), the calculated frequency and amplitude exhibit wide variance.

Figure 36:
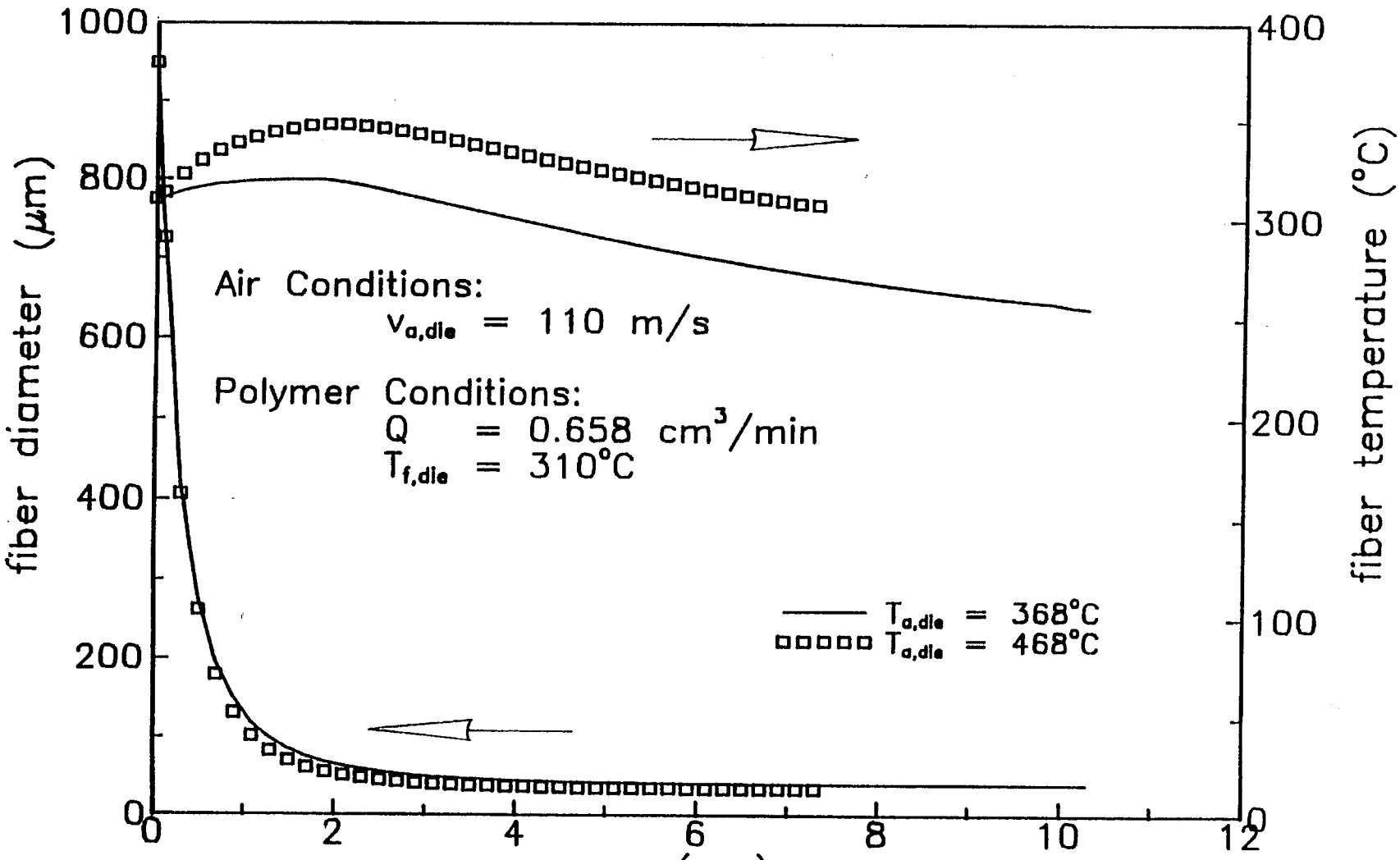
FIG. 36 is a graph showing the effect of air temperature on fiber diameter and fiber temperature profiles.

FIG. 36 shows how fiber diameter is affected by a 100° C. increase in air temperature. The effect is not great: attenuation only slightly increases. FIG. 36 also shows how air temperature affects fiber temperature along the threadline. For the high air temperature, the fiber temperature increases substantially in the first 2 cm below the spinneret. For y>3 cm, the slopes of the two temperature curves are the same, and the delta between the two curves is maintained.

For the same conditions listed on FIG. 36, a 100° C. increase in air temperature causes the maximum stress to move slightly closer to the die and the stress drops off more rapidly. Specifically, for $T_{a,die}$=468° C. the maximum stress of $2.70\times10^4$ Pa occurs at y=1.7 cm and the stress reaches zero (the stop point criterion) at y=7.5 cm. For comparison, see FIG. 30 or FIG. 33 for the stress curve with $T_{a,die}$=368° C. A 100° C. increase in air temperature has small effect on fiber diameter and stress. However, as FIG. 36 shows, fiber temperature is substantially changed by a 100° C. increase in air temperature.

The effect of increased air temperature is even more pronounced for the case of vibration amplitude. For the conditions listed on FIG. 36, a 100° C. increase in air temperature results in amplitude values (maximum |x| values) of about 0.05 cm. In comparison, the maximum amplitude values at T=368° C. are less than 0.01 cm; see FIG. 34. If plotted on FIG. 34, the amplitude values for $T_{a,die}$=468° C. would lie between the curve for $v_{a,die}$=150 m/s and $v_{a,die}$=200 m/s.

The frequency of fiber vibration decreases by more than 50% when air temperature is increased 100° C. For the conditions listed on FIG. 36, a 100° C. increase in air temperature decreases the frequency of fiber vibration (determined from the crossover rate) from about 45 to about 20 Hz. If plotted on FIG. 35, the frequency curve for $T_{a,die}$=468° C. would nearly overlay the curve for $V_{a,die}$=200 m/S.

Figure 37:
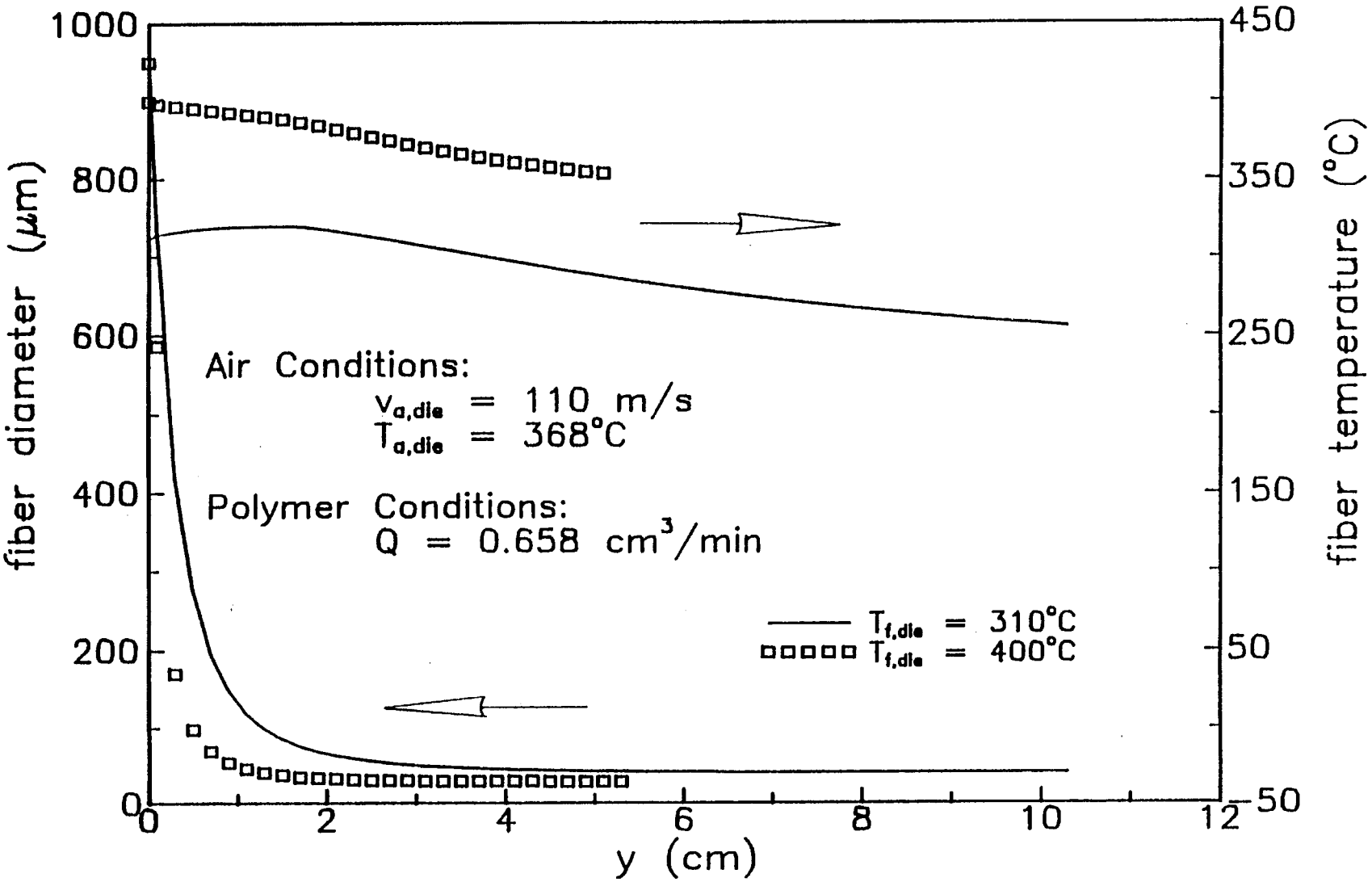

FIG. 37 illustrates how a 90° C. increase in polymer temperature causes a substantial increase in the rate of diameter attenuation. FIG. 37 also shows that an increase in polymer temperature causes a substantial increase in threadline temperature over the entire threadline.

The stress maximum is reached much closer to the die when the polymer temperature is increased. For the conditions listed on FIG. 37, for $T_{f,die}$=400° C. a maximum stress of $2.80\times10^4$ Pa occurs at y=1.1 cm and the stress reaches zero (the stop point criterion) at y=5.5 cm. For comparison, see FIG. 30 or FIG. 33 for the stress curve for $T_{f,die}$=310° C.

For the conditions listed on FIG. 37, a 90° C. increase in polymer temperature also causes over an order of magnitude increase in amplitude and an order of magnitude decrease in vibration frequency. For the 90° C. higher polymer temperature, the amplitude curve reaches a maximum of about 0.18 cm (for $T_{f,die}$=310° C., the maximum amplitude is less than 0.01 cm). If plotted on FIG. 34, the amplitude curve for $T_{f,die}$=400° C. would lie just slightly below the curve for $v_{a,die}$=300 m/s. The frequency of vibration is only about 3 Hz at $T_{f,die}$=400° C. This is only about a fifteenth of the 45 Hz frequency which is predicted for $T_{f,die}$=310° C.; see FIG. 35.

FIG. 38 shows how fiber diameter is affected by halving and doubling the polymer flowrate. As expected, lower polymer flowrates give finer fibers and more rapid attenuation. FIG. 38 also shows that, for y<3.1 cm, threadline temperatures are higher at lower polymer flowrates, while the situation is reversed for y>3.1 cm. These results are expected, since the temperature along a fine filament (resulting from a lower polymer flowrate) will be closer to the surrounding air temperature than the temperature along a thick filament.

The stress maximum moves closer to the die as polymer flowrate is decreased. For Q=0.329 $cm^3$/min (and the conditions listed on FIG. 38), the maximum stress of $5.7\times10^4$ Pa occurs at y=1.7 cm and the stress reaches 0 (the stop point criterion) at y=7.5 cm. At a high flowrate of 1.316 $cm^3$/min, the maximum stress of $1.2\times10^4$ Pa occurs at y=2.3 cm and the stress reaches zero at y=14.2 cm. See FIG. 30 or FIG. 33 for the stress curve at Q=0.658 $cm^3$/min.

For the conditions listed on FIG. 38, reducing the polymer flowrate by one-half (to 0.329 $cm^3$/min) causes the maximum amplitude to about double to 0.0174 cm. If the polymer flowrate is doubled (from 0.658 to 1.316 $cm^3$/min), the-maximum amplitude is reduced to 0.00027 cm. This is about a 30-fold reduction in amplitude.

For the polymer flowrate range investigated, the vibration frequency is inversely related to polymer flowrate. For Q=0.329, 0.658, and 1.316 $cm^3$/min, the frequencies are, respectively, 96, 45, and 13 Hz.

Amplitude of Vibration

Multiple-exposure strobe photographs of the melt blowing threadline were taken as described in the experimental equipment section.

FIG. 39 is the model's prediction of what a melt blowing "cone" should look like. Specifically, FIG. 39 shows the fiber positions for twenty-five times: t=4.76 sec, t=4.77 sec, . . . , t=4.99 sec, and t=5.00 sec. The conditions used as inputs to the model were exactly the same as those used in the experiments. Qualitatively, the model gives an excellent prediction of the fiber motion shown in the multiple-exposure photograph. However, the model underpredicts the measured vibration amplitude. For example, at y=1 cm the model predicts an amplitude of 0.014 cm, while the photographically measured amplitude is 0.070 cm. Air currents below the die could possibly be the cause of the larger amplitudes observed in the photographs.

Cohesive Fracture

As described in the Introduction, fiber breakup occurs when the melt blowing process transitions from region I into region II. As described by Ziabicki, A. ("Fundamentals of Fibre Formation", John Wiley and Sons: London, 1976, pp. 15–24 and 177–181), fiber breakup is caused by cohesive fracture and/or capillary action. Capillary breakup is driven by surface tension effects. Since surface tension effects were not included in our model, no prediction of fiber breakup due to capillary action can be made. However, for melt blown fibers which are of the diameters of typical melt spun fibers, capillary effects are probably too small to cause breakup (Ziabicki, 1976). Cohesive fracture occurs when the tensile stress in the fiber exceeds a critical stress value; this critical stress value is a function of temperature and elongation rate (Ziabicki, 1976).

Polypropylene has a tensile strength on the order of $10^9$ $N/m^2$ at room temperature (Billmeyer, F. W., "Textbook of Polymer Science", 3rd ed Wiley Interscience: New York, N.Y., 1984, pp 502–503). At 180° C. the tensile strength drops to about $3*10^4$ N/m$^2$ (Han, C. D. and Lamonte, R. R., "Studies on Melt Spinning, I. Effect of Molecular Structure and Molecular Weight Distribution on Elongational Viscosity", *Trans. Soc. Rheol.*, 1972 16(3), pp. 447–472). This stress level is of the order of the stress levels achieved when melt blowing at high gas velocities; see FIG. 33.

In conclusion with the use of fundamental transport equations, the present model has been developed to simulate the melt blowing process. The model output gives information about the thermal and mechanical history of the fiber stream as it travels from the melt blowing die towards the collection screen. Information about the fiber includes diameter, rheological stress, temperature, amplitude of vibration, and frequency of vibration. The model can aid the optimization and improvement of the melt blowing process.

NOMENCLATURE $C_{DN}$=drag force coefficient based on the drag force perpendicular to the filament and the normal component of velocity ($v_N$)

$C_f$=friction factor for parallel flow of fluid along the filament surface $C_{p,f}$=fiber heat capacity, J/kg·K $d_{AN}$=outer diameter of annular die orifice, mm $d_f$=diameter of filament, μm $d_o$=median diameter of filaments used in the correlation of Ju and Shambaugh (1993); $d_o$=78 μm $f_{PAR}$=unit vector along the z axis (see FIG. 27)

$f_N$=unit vector normal to z axis (see FIG. 27)

$F_D$=aerodynamic force on the filament in the y direction, N $F_L$=aerodynamic force on the filament in the x direction, N $F_N$=drag force normal to the major axis of the fiber, N $F_{PAR}$=drag force parallel to the major axis of the fiber, N $F_{rheo}$=rheological force, N $F_T$=total force on the fiber, N h=convective heat transfer coefficient, W/m$^2$·K $k_a$=thermal conductivity of air, W/m·K l=y value at upper control surface of the control volume l+Δl=y value at lower control surface of the control volume $L_f$=length of an element of the filament, m m=fiber mass Nu=Nusselt number for heat transfer between the air and the fiber Q=polymer rate through the die, cm$^3$/min $Re_{DN}$=Reynolds number based on filament diameter and the component of velocity perpendicular to the filament axis $Re_{DP}$=Reynolds number based on filament diameter and the component of velocity parallel to the filament axis $Re_{eff}$=Reynolds number defined by eq. 32.

$T_a$=air temperature, °C.

$T_{a,die}$=air temperature at die (y=0), °C.

$T_f$=filament temperature, °C.

$T_{f,die}$=filament temperature at die (y=0), °C.

$v_a$=free stream air velocity, m/s $v_{a,die}=v_{jo}$=air velocity at the die (y=0), m/s $v_f$=fiber velocity, m/s $v_{a,eff,N}$=component of effective air velocity which is normal to the filament axis, m/s $v_{a,eff,PAR}$=component of effective air velocity which is parallel to the filament axis, m/s $v_o$=maximum air velocity at a fixed y, m/s $v_{jo}=v_{a,die}$=air velocity at die (y=0), m/s $v_{a,eff}$=the effective, or relative, velocity of the air with respect to the fiber, m/s x=horizontal coordinate; see FIG. 27 x'=coordinate direction normal to z $x_{1/2}$=air velocity half-width, mm y=vertical coordinate; see FIG. 27

$y(d_{AN})=Y/d_{AN}(\rho_{a\infty}/\rho_{aO})^{1/2}$ z=coordinate position along fiber axis; see FIG. 27

Greek Letters

α=angle between the y axis and the major axis of the filament; see FIG. 27

β=the angle between the y axis and the fiber velocity; see FIG. 27. Also, β is the leading coefficient in the Matsui (1976) relation.

$\eta_{fz}$=fiber viscosity, Pa·s $\eta_o$=zero shear viscosity, Pa·s $\theta_{jo}$=excess air temperature above ambient at die exit, °C.

$\theta_o$=excess air temperature above ambient along the centerline (the y axis), °C.

$\mu_a$=air viscosity, Pa·s $\nu_a$=kinematic air viscosity, m$^2$/s $\rho_a$=air density, kg/m$^3$ $\rho_{aO}$=air density along the center line downstream from the nozzle, kg/m$^3$ $\rho_{a\infty}$=air density at ambient conditions, kg/m$^3$ τ=extra stress, Pa ψ=angle between $v_{a,eff}$ and the fiber axis; see FIG. 27

Subscripts a=air die=die eff=effective f=fiber i=fiber element i and control volume i N=normal PAR=parallel rheo=rheological Superscripts x'=coordinate in direction transverse to the fiber axis z=coordinate position along the fiber axis Each of the references cited herein is hereby incorporated herein by reference.

Changes may be made in the construction and the operation of the various components, elements and assemblies described herein or in the steps or the sequence of steps of the methods described herein without departing from the spirit and scope of the invention as defined in the following claims.

What is claimed is:

1. A method for selecting operating conditions in a melt blowing operation, comprising:

providing a mathematical model which simulates a polymer stream in a melt blowing process and which accounts for transverse motion of fibers in the polymer stream;

providing a set of parameter values for inputting into the model;

running the model with the set of parameter values;

selecting from the set of parameter values a subset of parameter values which optimize the melt blowing process; and using the subset of parameter values in an actual melt blowing operation.

2. A method for selecting operating conditions in a melt blowing operation, comprising:

providing a mathematical model which simulates a polymer stream in a melt blowing process and which accounts for transverse motion of fibers in the polymer stream;

providing a set of parameter values for inputting into the model wherein the set of parameter values comprises at least a pulsating gas flow rate;

running the model with the set of parameter values;

selecting from the set of parameter values a subset of parameter values which optimize the melt blowing process; and using the subset of parameter values in an actual melt blowing operation.

* * * * *

UNITED STATES PATENT AND TRADEMARK OFFICE

CERTIFICATE OF CORRECTION

PATENT NO. : 5,523,033

DATED : June 4, 1996

INVENTOR(S) : Shambaugh

It is certified that error appears in the above-identified patent and that said Letters Patent is hereby corrected as shown below:

Column 3, line 8, after "Shambaugh" please insert --(U-S)--.

Column 4, line 2, please delete "4,350,570" and substitute therefor --4,380,570--.

Column 13, line 26, after "One Constant Primary Gas Flow with" please insert --Pulsating Second--.

Column 13, line 57, after "first primary gas flow slot" please insert --84--.

Column 17, please delete equation 2 and substitute therefor --

$$(F_L - F_{rheo,x,\ell} + F_{rheo,x,\ell+\Delta\ell})\,|_i = -(v_{f,x}\rho_f v_{f,y}A)\,|_{i,\ell} + (v_{f,x}\rho_f v_{f,y}A)\,|_{i,\ell+\Delta\ell}$$

$$+ v_{f,x,i}\frac{\Delta m_i}{\Delta t} + m_i\frac{\Delta v_{f,x,i}}{\Delta t}$$

UNITED STATES PATENT AND TRADEMARK OFFICE

CERTIFICATE OF CORRECTION

PATENT NO. : 5,523,033

DATED : June 4, 1996

INVENTOR(S) : Shambaugh

It is certified that error appears in the above-identified patent and that said Letters Patent is hereby corrected as shown below:

Column 18, please delete equation 9 and substitute therefor --

$$\frac{dx_{f,i}}{dt} = v_{f,x,i}$$

Column 20, please delete equation 23 and substitute therefor --

$$\overline{v_{a,eff}} = (v_{a,x} - v_{f,x,i})\,\mathbf{I} + (v_{a,y} - v_{f,y,i})\,\mathbf{J}$$

Column 20, please delete equation 25 and substitute therefor --

$$\overline{v_{a,eff,PAR}} = (\overline{v_{a,eff}} \cdot \overline{f_{PAR}})\,\overline{f_{PAR}}$$

UNITED STATES PATENT AND TRADEMARK OFFICE

CERTIFICATE OF CORRECTION

PATENT NO. : 5,523,033

DATED : June 4, 1996

INVENTOR(S) : Shambaugh

It is certified that error appears in the above-indentified patent and that said Letters Patent is hereby corrected as shown below:

Column 26, line 48, before "m/s air velocity" please insert --300--.

Signed and Sealed this

Fifteenth Day of October, 1996

Bruce Lehman

*Attest:*

BRUCE LEHMAN

*Attesting Officer*

*Commissioner of Patents and Trademarks*